US010667989B2

(12) United States Patent
von Schenck et al.

(10) Patent No.: US 10,667,989 B2
(45) Date of Patent: Jun. 2, 2020

(54) CARDIO-PULMONARY RESUSCITATION MACHINES WITH STABILIZING MEMBERS AND METHODS

(71) Applicant: Jolife AB, Lund (SE)

(72) Inventors: Erik von Schenck, Lomma (SE); Marcus Ehrstedt, Lund (SE)

(73) Assignee: JOLIFE AB, Lund (SE)

( * ) Notice: Subject to any disclaimer, the term of this patent is extended or adjusted under 35 U.S.C. 154(b) by 1142 days.

(21) Appl. No.: 15/047,514

(22) Filed: Feb. 18, 2016

(65) Prior Publication Data

US 2016/0242996 A1 Aug. 25, 2016

Related U.S. Application Data

(60) Provisional application No. 62/120,324, filed on Feb. 24, 2015.

(51) Int. Cl.
*A61H 31/00* (2006.01)
*A61G 1/003* (2006.01)
(Continued)

(52) U.S. Cl.
CPC ..... *A61H 31/006* (2013.01); *A61G 1/003* (2013.01); *A61G 1/013* (2013.01); *A61G 1/048* (2013.01);
(Continued)

(58) Field of Classification Search
CPC .... A61H 31/00; A61H 31/004; A61H 31/006; A61H 31/007; A61H 31/008;
(Continued)

(56) References Cited

U.S. PATENT DOCUMENTS 1,918,546 A * 7/1933 Johnson ..... A61H 31/00 601/41
3,552,390 A * 1/1971 Muller ..... A61H 31/006 601/97
(Continued)

FOREIGN PATENT DOCUMENTS

CN 103340741 A 10/2013
EP 2500008 A2 9/2012
(Continued)

OTHER PUBLICATIONS

International Search Report and Written Opinion of PCT Application IB2016000241.
Machine translation of cited Chinese patent CN103340741A.

*Primary Examiner* — Michael J Tsai
(74) *Attorney, Agent, or Firm* — Miller Nash Graham & Dunn LLP

(57) ABSTRACT

In embodiments, a Cardio-Pulmonary Resuscitation (CPR) system includes a retention structure, a compression mechanism coupled to the retention structure and a backboard. The retention structure and the backboard can be assembled together so as to form a closed loop that surrounds the patient's torso, and a piston of the compression mechanism is movable towards and away from a chest of a patient. In addition, the CPR system has a stabilizing member, and a coupler configured to couple the stabilizing member to the backboard. The stabilizing member can prevent the retention structure from tilting while the CPR system delivers chest compressions to the patient.

12 Claims, 20 Drawing Sheets

(51) Int. Cl.
*A61G 1/048* (2006.01)
*A61G 1/013* (2006.01)

(52) U.S. Cl.
CPC ..... *A61H 31/004* (2013.01); *A61H 31/008* (2013.01); *A61H 2201/0107* (2013.01); *A61H 2201/0119* (2013.01); *A61H 2201/0161* (2013.01); *A61H 2201/1207* (2013.01); *A61H 2201/1246* (2013.01); *A61H 2201/1619* (2013.01); *A61H 2201/1664* (2013.01); *A61H 2201/5007* (2013.01)

(58) Field of Classification Search
CPC .... A61H 2201/0119; A61H 2201/0138; A61H 2201/1619; A61H 2201/1621; A61H 2201/1623; A61H 2201/1626; A61H 2201/1628; A61H 2201/163; A61H 2205/08; A61H 2205/081; A61H 2205/083; A61H 2205/084; A61H 2205/088; A61H 2203/0456; A61H 2203/0468
USPC ..... 248/188.6, 188.7, 188.8, 165, 346.3
See application file for complete search history.

(56) References Cited

U.S. PATENT DOCUMENTS 3,739,771 A * 6/1973 Gaquer ..... A61H 31/007 601/97
3,985,126 A 10/1976 Barkalow
4,635,811 A * 1/1987 Lodi ..... F16M 11/22 220/23.4
4,770,164 A * 9/1988 Lach ..... A61H 31/005 601/41
6,288,893 B1 * 9/2001 Faranda ..... G06F 1/181 312/223.2
7,269,001 B2 * 9/2007 Huang ..... H05K 5/0004 248/188.8
7,550,668 B2 * 6/2009 Chen ..... H05K 5/0234 174/50
7,841,996 B2 11/2010 Sebelius et al.
8,191,838 B2 * 6/2012 Carter ..... B60R 11/02 16/367
8,701,929 B1 * 4/2014 Long ..... B65D 25/22 215/276
2003/0181834 A1 9/2003 Sebelius et al.
2016/0095765 A1 * 4/2016 Ehrstedt ..... A61G 1/044 128/869
2016/0338904 A1 * 11/2016 Lurie ..... A61G 13/129
2017/0071820 A1 * 3/2017 Illindala ..... A61H 31/008
2017/0156979 A1 * 6/2017 Walden ..... A61H 31/006
2019/0046394 A1 * 2/2019 Lurie ..... A61G 1/04
2019/0274920 A1 * 9/2019 Williams ..... A61H 31/008

FOREIGN PATENT DOCUMENTS

WO 2000/023034 A1 4/2000
WO 2008/066455 A1 6/2008
WO 2010/119401 A1 10/2010

* cited by examiner

*METHODS*

CARDIO-PULMONARY RESUSCITATION MACHINES WITH STABILIZING MEMBERS AND METHODS

CROSS REFERENCE TO RELATED PATENT APPLICATIONS

This patent application claims priority from U.S. Provisional Patent Application Ser. No. 62/120,324, filed on Feb. 24, 2015, the disclosure of which, as initially made, is hereby incorporated by reference.

BACKGROUND

In certain types of medical emergencies a patient's heart stops working, which stops the blood from flowing. Without the blood flowing, organs like the brain will start becoming damaged, and the patient will soon die. Cardiopulmonary resuscitation (CPR) can forestall these risks. CPR includes performing repeated chest compressions to the chest of the patient, so as to cause the patient's blood to circulate some. CPR also includes delivering rescue breaths to the patient, so as to create air circulation in the lungs. CPR is intended to merely forestall organ damage and death, until a more definitive treatment is made available. Defibrillation is such a definitive treatment: it is an electric shock delivered deliberately to the patient's heart, in the hope of restoring their heart rhythm.

Guidelines by medical experts such as the American Heart Association provide parameters for CPR to cause the blood to circulate effectively. The parameters are for aspects such as the frequency of the compressions, the depth that they should reach, and the full release that is to follow each of them. The depth is sometimes required to reach 5 cm (2 in.). The parameters for CPR also include instructions for the rescue breaths.

Traditionally, CPR has been performed manually. A number of people have been trained in CPR, including some who are not in the medical professions, just in case they are bystanders in an emergency event.

Manual CPR may be ineffective, however. Indeed, the rescuer might not be able to recall their training, especially under the stress of the moment. And even the best trained rescuer can become fatigued from performing the chest compressions for a long time, at which point their performance may become degraded. In the end, chest compressions that are not frequent enough, not deep enough, or not followed by a full release may fail to maintain the blood circulation required to forestall organ damage and death.

The risk of ineffective chest compressions has been addressed with CPR chest compression machines. Such machines have been known by a number of names, for example CPR chest compression machines, CPR machines, mechanical CPR devices, cardiac compressors, CPR systems, and so on.

CPR chest compression machines typically hold the patient supine, which means lying on his or her back. Such machines then repeatedly compress and release the chest of the patient. In fact, they can be programmed to automatically follow the guidelines, by compressing and releasing at the recommended rate or frequency, while reaching a specific depth.

BRIEF SUMMARY

The present description gives instances of Cardio-Pulmonary Resuscitation (CPR) systems, CPR machines, and methods for rescuers, the use of which may help overcome problems and limitations of the prior art.

In embodiments, a Cardio-Pulmonary Resuscitation (CPR) system includes a retention structure, a compression mechanism coupled to the retention structure and a backboard. The retention structure and the backboard can be assembled together so as to form a closed loop that surrounds the patient's torso, and a piston of the compression mechanism is movable towards and away from a chest of a patient. In addition, the CPR system has a stabilizing member, and a coupler configured to couple the stabilizing member to the backboard.

An advantage over the prior art is that the stabilizing member can prevent the retention structure from tilting while the CPR system delivers chest compressions to the patient. Tilting, if permitted for some time, may result in subsequent compressions being delivered by the piston to a point on the chest that migrates away from a point where the effect of the compressions is optimized.

In additional embodiments, a stretcher is modular, in that it has a back segment and a head segment that can be coupled to the back segment. It optionally has a legs segment that can be coupled to the back segment. The stretcher can be assembled around a backboard of a CPR machine that is on the ground. This permits rescuers to first attach the CPR machine to a patient and turn it on, so as to forestall the patient's death, and then to assemble the stretcher while the CPR machine is working. The stretcher can be used for transporting the patient to a care center. The modular stretcher may be later disassembled for easier storing, even fitting in a backpack.

These and other features and advantages of this description will become more readily apparent from the Detailed Description, which proceeds with reference to the associated drawings in which:

BRIEF DESCRIPTION OF THE DRAWINGS

FIG. 15 shows a left back portion of the modular stretcher being initially brought close to the backboard.

FIG. 16 shows the arrangement of FIG. 15, in which a right back portion of the modular stretcher is subsequently used.

FIG. 17 shows the arrangement of FIG. 16, in which the left back portion and the right back portion have been subsequently assembled with each other.

FIG. 18 shows the arrangement of FIG. 17, in which a head segment of the modular stretcher is subsequently brought close to the backboard.

FIG. 19 shows the arrangement of FIG. 18, in which the head segment has been subsequently assembled.

FIG. 20 shows the arrangement of FIG. 19, in which a legs segment of the modular stretcher is subsequently brought close to the remainder.

FIG. 21 shows the arrangement of FIG. 20, in which the legs segment has been assembled with the remainder of the modular stretcher.

DETAILED DESCRIPTION

As has been mentioned, the present description is about Cardio-Pulmonary Resuscitation (CPR) systems, CPR machines, and methods. Embodiments are now described in more detail.

Figure 1:
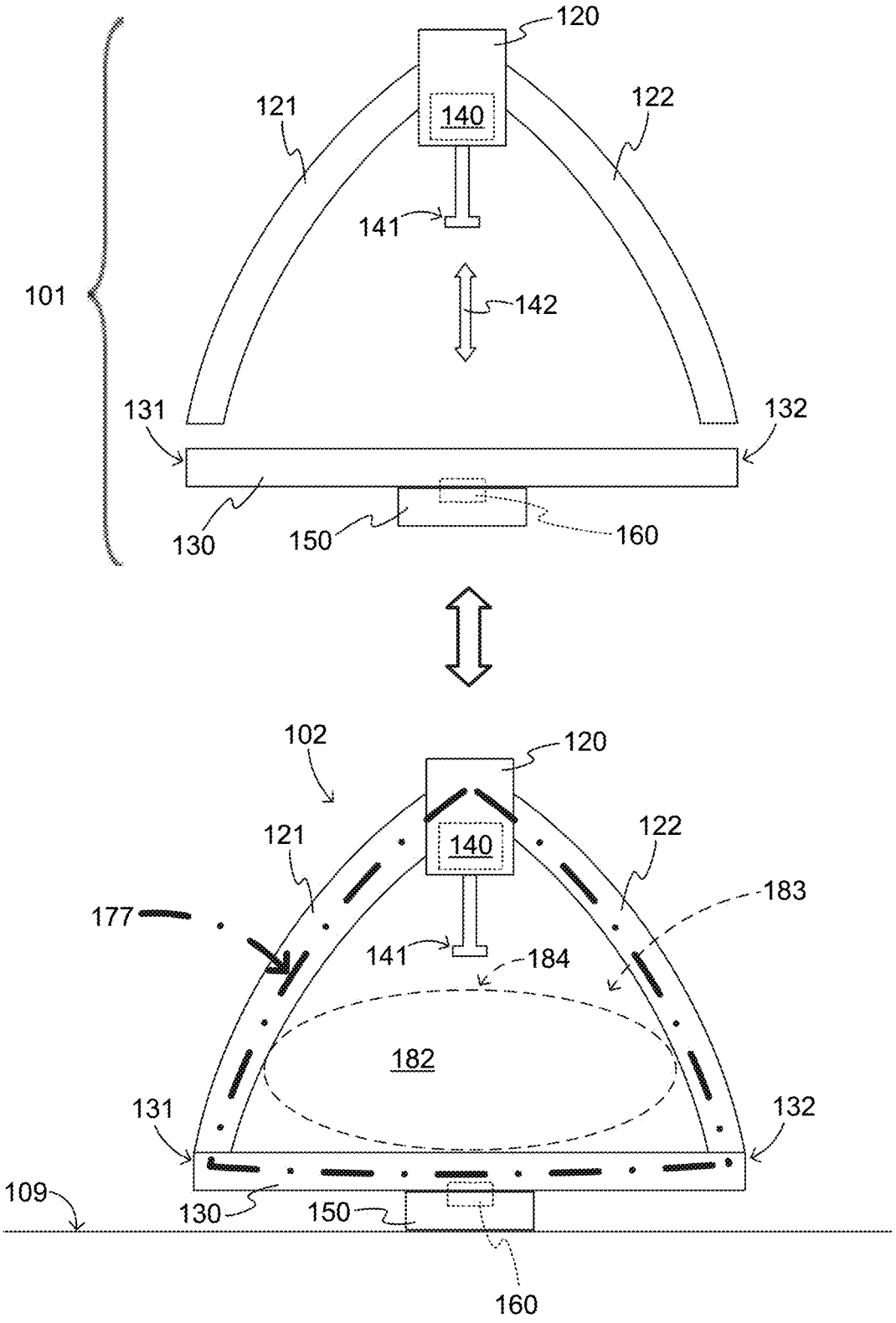
FIG. 1 is a dual diagram of frontal section views of components of a sample CPR system with a stabilizing member, in both partially unassembled and fully assembled states, according to embodiments.

FIG. 1 is a dual diagram. A set of components 101 of a sample CPR system is shown in a state that is unassembled at least partially. As will be appreciated, the unassembled state might be such that it facilitates storage. The components in the unassembled state can be manipulated so that that they can be assembled for caring for a patient. FIG. 1 also shows a sample CPR system 102 that has been so assembled from components 101, for caring for a patient 182.

Components 101 are now described in more detail. Components 101 include a retention structure. In this example, the retention structure includes a box 120 and two legs 121, 122 coupled to box 120. In examples such as the one shown, legs 121, 122 are optionally rotatable with respect to box 120, so as to present a more compact object for storage.

Components 101 also include a compression mechanism 140 coupled to the retention structure. In this example, compression mechanism 140 is so coupled by being located within box 120. Compression mechanism 140 has a movable piston 141. Compression mechanism 140 can be configured to perform the CPR compressions to the patient's chest, and then releases after the compressions, by moving piston 141. Motion would be along arrow 142, with the compressions in the downward direction and the releases in the upward direction.

Components 101 additionally include a backboard 130. Backboard 130 could have the shape of a board. The intent is to place the patient's back on backboard 130. While backboard 130 is shown as flat in FIG. 1, this is not necessarily always the case; in fact backboard 130 could be curved, so that it better matches the contour of the patient's back. While backboard 130 is shown as rectangular in FIGS. 1 and 2, this is not necessarily always the case; in fact backboard 130 could be larger in the middle, for greater stability.

Components 101 moreover include a stabilizing member 150, which is distinct, different from backboard 130. Embodiments of stabilizing member 150 are described in more detail later in this document.

Components 101 furthermore include a coupler 160, which is shown only generically in FIG. 1. Coupler 160 is structurally configured to couple stabilizing member 150 to backboard 130 in ways that are described later in this document.

Components 101 are shown in an unassembled state. In particular, edges 131, 132 of backboard 130 are not coupled respectively to legs 121, 122 of the retention structure. In some embodiments, components 101 may be disassembled by the user even further.

In embodiments, the retention structure (i.e. box 120 and legs 121, 122), and backboard 130 can be assembled together so as to form a closed loop that surrounds a torso of a patient completely. A closed loop is sometimes defined as a loop that can be drawn by a pencil on paper without lifting the pencil from the paper. Examples are now described.

FIG. 1 also shows a sample CPR system 102 on a flat surface 109, which can be the ground, a floor, etc. CPR system 102 has been formed by assembling together the retention structure (i.e. box 120 and legs 121, 122), and backboard 130 of components 101. For this assembling, edges 131, 132 of backboard 130 have been coupled respectively to legs 121, 122 of the retention structure. The assembling has resulted in forming a closed loop 177 that surrounds completely a torso 183 of patient 182. Patient 182 is supine, i.e. lying on his or her back on backboard 130. The retention structure thus retains the patient's body, and may be implemented in a number of ways. Good embodiments are disclosed in U.S. Pat. No. 7,569,021 to Jolife A B which is incorporated by reference.

Further, the assembling of the retention structure and the backboard may result in the piston of the compression mechanism being movable towards and away from a chest of a patient, which is part of their torso. For example, in FIG. 1 piston 141 can thus be moved towards and away from a chest 184 of patient 182, when compression mechanism 140 is turned on from a user interface.

It will be observed that stabilizing member 150 cannot be assembled so as to become part of closed loop 177. In fact, stabilizing member 150 is movable at least some times with respect to backboard 130, as will be seen in more detail later in this document.

Figure 2:
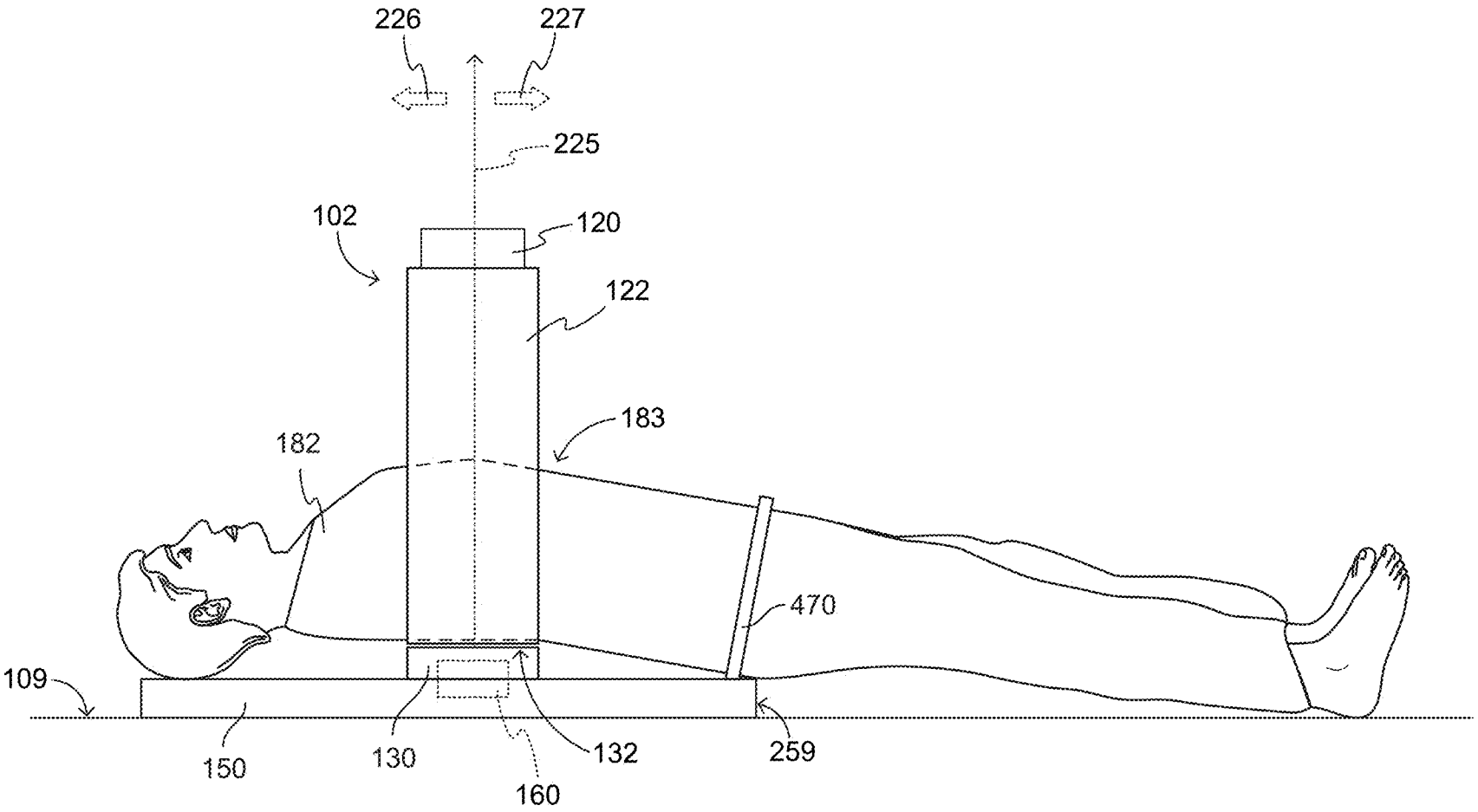
FIG. 2 is a diagram of a side view of the components of FIG. 1 in the assembled state.

FIG. 2 is a diagram of a side view of the components of FIG. 1 in the assembled state. It will be appreciated that stabilizing member 150 is oblong in this example, with its length dimension revealed in FIG. 2 being longer than its width dimension revealed in FIG. 1.

The retention structure (120, 122) has a risk of tilting. This risk is shown by a semi-axis 225 of the retention structure possibly tilting towards the head of the patient (arrow 226), or towards the feet of the patient (arrow 227). The risk of tilting may arise from how the chest of the patient is sloped at the point where the piston contacts the chest, given the force of the piston. If not addressed, this tilting may result, after some compressions and releases, in the piston migrating up or down along the chest of the patient, and thus continuing to compress at an unintended location on the chest. The retention structure (120, 122) also has a risk of tilting and falling when being displayed.

It will be appreciated that stabilizing member 150 can prevent this tilting along axis 225. In particular, it will be observed that stabilizing member 150 rests on ground 109 with its longer dimension parallel to the ground in the side view of FIG. 2, perpendicular to semi-axis 225. Accordingly, stabilizing member 150, via coupler 160 and backboard 130, prevents the retention structure from tilting in the directions of arrows 226, 227.

Stabilizing member 150 can be made from any number of suitable materials. Such materials can be hard plastics, metals, or even x-ray transparent materials, for example materials similar to those used for making backboard 130.

In some instances it is desired to extend stabilizing member 150. Such may be implemented by extensions, which can be adjustable, that can be selectively added to the ends of stabilizing member 150, so as to increase its length. Such extensions can be coupled to stabilizing member 150 by locking mechanisms, etc.

Figure 3:
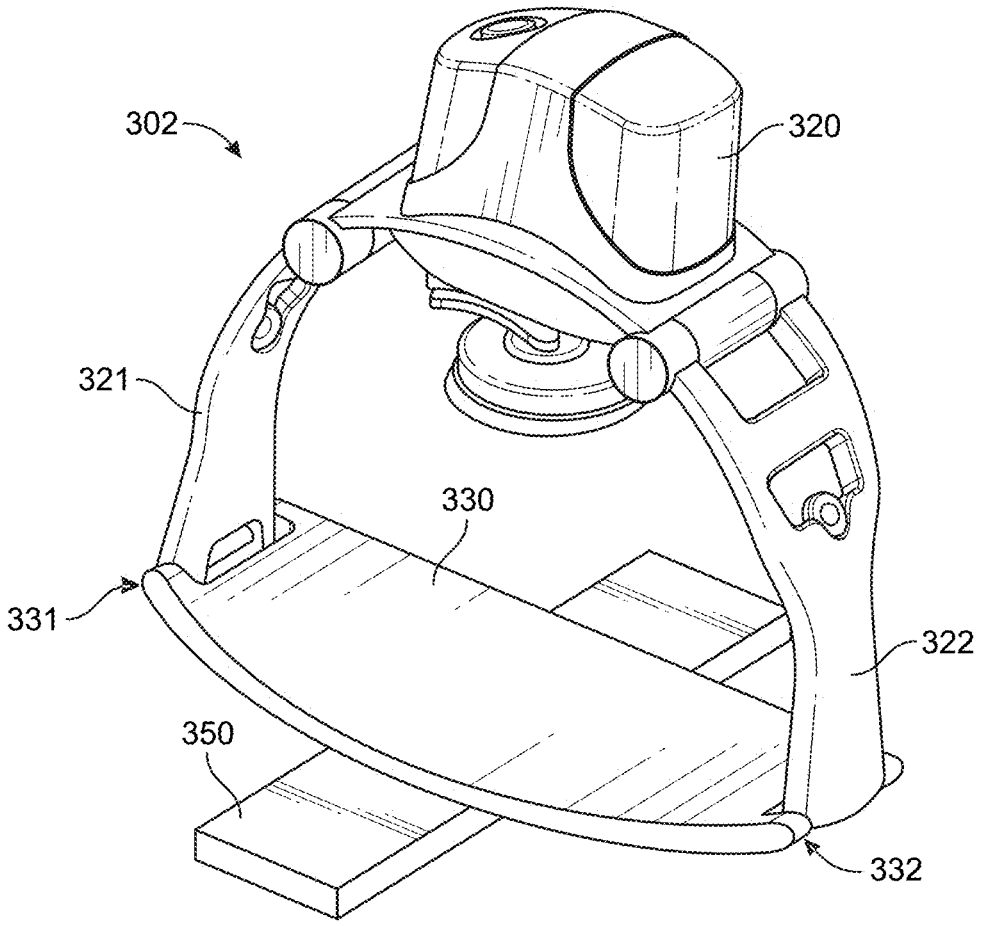
FIG. 3 is a perspective view of a sample CPR machine with a stabilizing member, made according to embodiments.

FIG. 3 is a perspective view of a sample CPR machine 302, whose retention structure is a box 320 and legs 321, 322 that are coupled to box 320 rotatably. CPR machine 302 has a backboard 330 that has ends 331, 332, which are coupled to legs 321, 322 respectively. This top portion can be similar to the Lucas® mechanical CPR machine available from Physio-Control, Inc. Moreover, a stabilizing member 350 is coupled to backboard 330 via a coupler (not shown).

Figure 4:
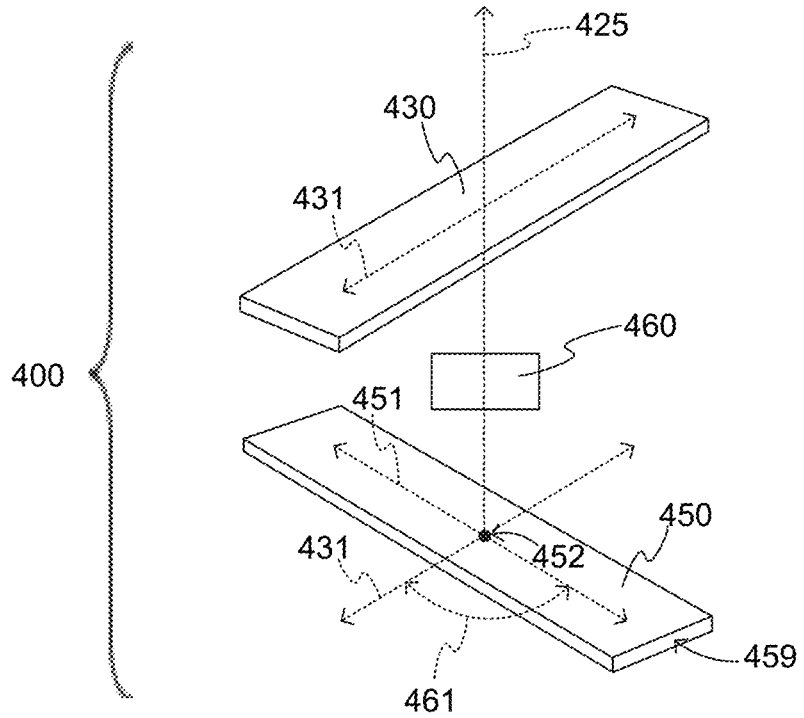
FIG. 4 is a diagram of a sample backboard, a sample stabilizing member and a generic coupler of a CPR machine made according to embodiments.

Embodiments for couplers are described later in this document. In FIG. 4, a combination 400 includes a sample backboard 430, a sample stabilizing member 450, and a generic coupler 460 for backboard 430 and stabilizing member 450.

Backboard 430 has a long dimension shown by a straight axis 431, which is superimposed on backboard 430. Backboard 430 is shown as being flat in this example, but it will be understood that axis 431 could represent its long dimension even if backboard 430 were curved, as it was in the example of FIG. 3.

In FIG. 4, stabilizing member 450 has a shape of an oblong board, similarly to what was shown in previous FIG.s. In fact, the stabilizing member can have a shape that is similar to a shape of the backboard, or a shape that can fit under the backboard. Such would facilitate storage of the whole system in the unassembled state, for example in a backpack, as it would present less bulk.

Stabilizing member 450 has a long dimension shown by a straight axis 451, which is superimposed on stabilizing member 450. Moreover, axis 431 can be transferred so that it intersects axis 451 at a point 452. Around this point 452, an angle 461 is subtended by axes 451 with respect to axis 431. When angle 461 is zero, stabilizing member 450 is aligned with backboard 430, presenting the least volume for storage. Angle 461 is shown as 90° in FIGS. 1, 2, and 3, which can optimize stability as explained with reference to FIG. 2.

In FIG. 4, an end 459 of stabilizing member 450 is considered the distal end. The distal end is considered to be the one that reaches the closest to the feet of the patient. While distal end 459 is shown in FIG. 4 as rectangularly shaped, this is not necessarily always the case. In fact, the distal end can be rounded, so as to present fewer sharp angles as it is under the patient.

The patient can be further tethered or secured to the stabilizing member, preferably near the distal end. For example, returning to FIG. 2, stabilizing member 150 can be considered to have a distal end 259. The CPR system optionally also includes at least one stabilizing strap 470. Strap 470 can be configured to secure a body of patient 182, for immobilizing it during CPR treatment. Strap 470 can be tied around the chest or stomach of patient 182. The patient's body can thus be secured this way directly to stabilizing member 150. For clarification about the use of the word "directly" in this document, if a strap had been used to secure the patient's body directly to the retention structure or directly to backboard 130, such would have resulted in securing the patient to the stabilizing member only indirectly, and not directly.

The stabilizing strap can be implemented in a number of ways. For example, it can be implemented by a flexible strap, a belt, an elastic band, a cord, etc. It can be secured around the patient by a buckle, Velcro, hooks, etc.

Figure 5:
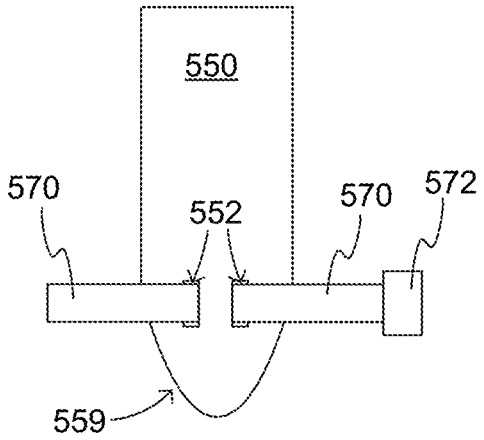
FIG. 5 is a diagram of a top view of a sample stabilizing member and a sample strap of a CPR machine made according to embodiments.

Stabilizing strap 470 can be coupled to stabilizing member 150 in a number of ways. As one example, FIG. 5 shows a stabilizing member 550 with a distal end 559. Stabilizing member 550 has one or more openings 552, preferably near distal end 559. A stabilizing strap 570 is configured to be passed through the one or more openings 552 for thus securing the patient's body directly to stabilizing member 550. In this example, stabilizing strap 570 has a buckle 572.

Figure 6:
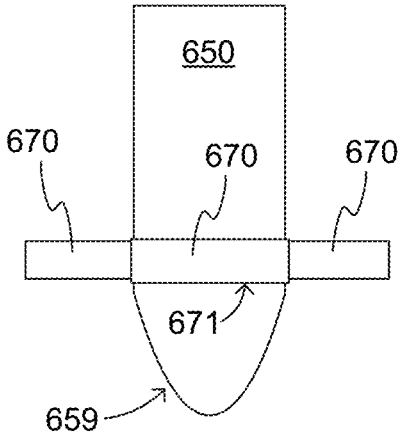
FIG. 6 is diagram of a top view of a sample stabilizing member and a sample strap of a CPR machine made according to embodiments.

As another example, FIG. 6 shows a stabilizing member 650 with a distal end 659. A stabilizing strap 670 is coupled to stabilizing member 650, for example by being tied to it, preferably near distal end 659. Tying can be by forming a loop, etc. In some of these embodiments, the stabilizing member includes a notch or slot, and the stabilizing strap can be configured to pass through the notch or slot so as not to migrate with respect to the stabilizing member.

In some embodiments, the coupler is configured to be used in such a way that the stabilizing member can become fixedly attached to the backboard, and then the stabilizing member can become completely separated from the backboard. Examples are now described.

Figure 7A:
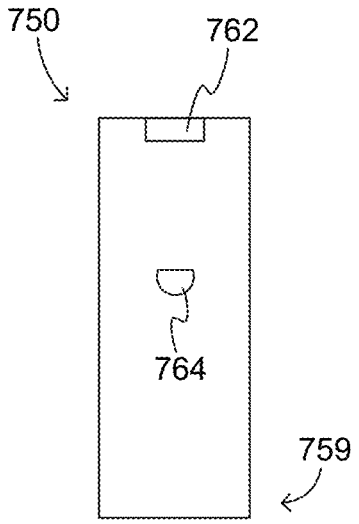
FIG. 7A is a diagram of a top view of sample stabilizing member of a CPR machine made according to embodiments.

In some embodiments, the coupler can include a bracket that is coupled to either the stabilizing member or the backboard. For example, FIG. 7A shows a stabilizing member 750 that has a distal end 759. In this example, the coupler includes a bracket 762 and a bracket 764. Brackets 762, 764 are coupled to the stabilizing member, and can be made out of metal, etc.

Figure 7B:
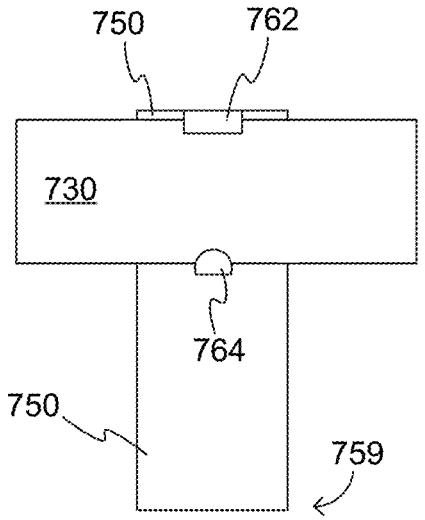
FIG. 7B is a diagram of a top view of the stabilizing member of FIG. 7A, to which a backboard has become fixedly attached according to an embodiment.

Moreover, the coupler can permit the stabilizing member to become fixedly attached to the backboard by the bracket becoming engaged with the backboard or the stabilizing member, depending on which of these two does not include the bracket. For example, FIG. 7B shows stabilizing member 750 of FIG. 7A, to which a backboard 730 has become fixedly attached. This attachment has been accomplished by brackets 762, 764 becoming engaged with backboard 730.

The arrangement of FIG. 7B allows a stabilizing member 750 to have maximum length while still being no larger than the footprint of backboard 730. In addition, when fixedly attached for such deployment, distal end 759 of stabilizing member 750 extends farther down the patient's back than the rotatable versions described below. As such, stabilizing member 750 may afford even more counter-torque to the forces that could tilt semi-axis 225 of FIG. 2.

In some embodiments, the bracket is coupled to the stabilizing member or to the backboard by being attached fixedly to it, as is bracket 762. In some embodiments, the bracket is coupled to the stabilizing member or to the backboard while being rotatable with respect to it. For example, contrasting how bracket 764 in FIG. 7A differently than in FIG. 7B reveals that bracket 764 has been rotated. Indeed, a top view of bracket 764 appears approximately like a semi-circle, with a rounded edge and a straight edge. In FIG. 7B the rounded edge is up, and bracket 764 engages backboard 730, so that stabilizing member 750 can become fixedly attached to backboard 730. In contrast, in FIG. 7A, the rounded edge is down, and bracket 764 would not be able to engage the backboard from that orientation; rather, bracket 764 would instead permit stabilizing member 750 to become completely separated from the backboard.

Figure 7C:
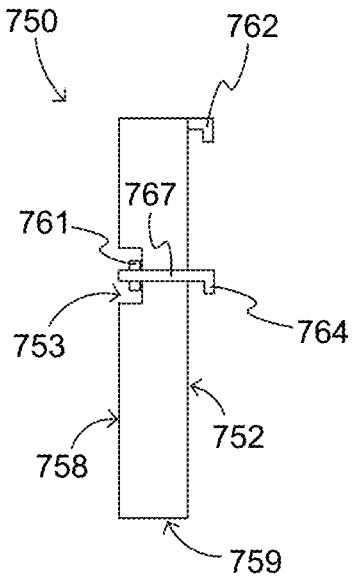
FIG. 7C is a diagram of a side view of the stabilizing member of FIG. 7A.

FIG. 7C shows a side view of stabilizing member 750 of FIG. 7A. As can be seen, bracket 764 can be rotated around a short axle 767. As is preferred, axle 767 terminates in threading similar to that of a screw. The coupler in this case also includes a nut 761 that is screwed onto the threading of axle 767. Nut 761 can be loosened so as to permit bracket 764 to be rotated to the desired orientation. When the backboard is placed as shown in FIG. 7B, then nut 761 can be tightened to secure bracket 764 in its desired orientation.

Figure 7D:
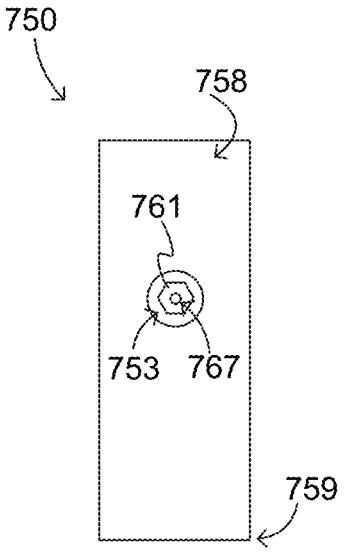
FIG. 7D is a diagram of a bottom view of the stabilizing member of FIG. 7A.

Stabilizing member 750 has a top surface 752, and a bottom surface 758 opposite top surface 752. Bracket 764 is on the top surface. In embodiments such as that of FIG. 7C, it is preferred that bottom surface 758 remain flat, without nut 761 protruding from it. Accordingly, a recess 753 may be provided in bottom surface 758, and nut 761 may be disposed within recess 753. This is also shown in FIG. 7D, which shows bottom surface 758 of stabilizing member 750.

Figure 8A:
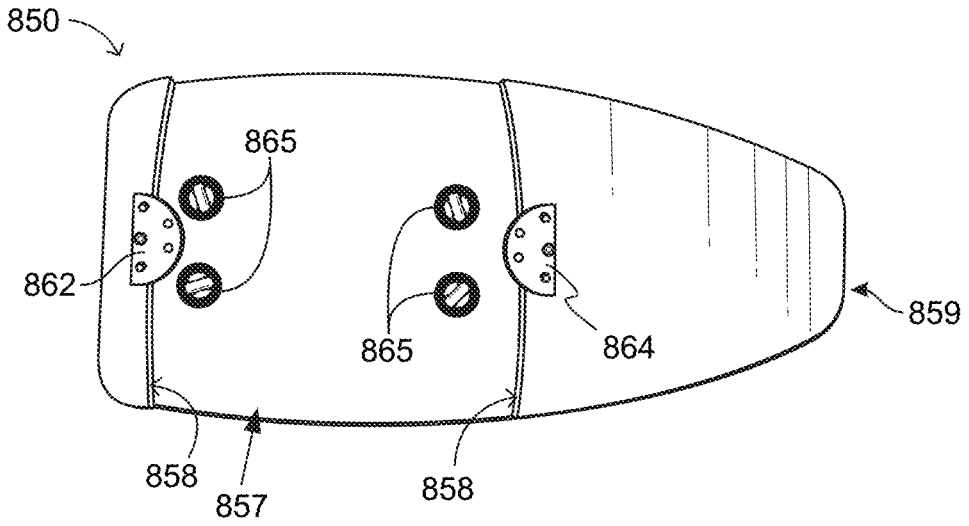
FIG. 8A is a diagram of a top view of a sample stabilizing member of a CPR machine made according to embodiments.
Figure 8B:
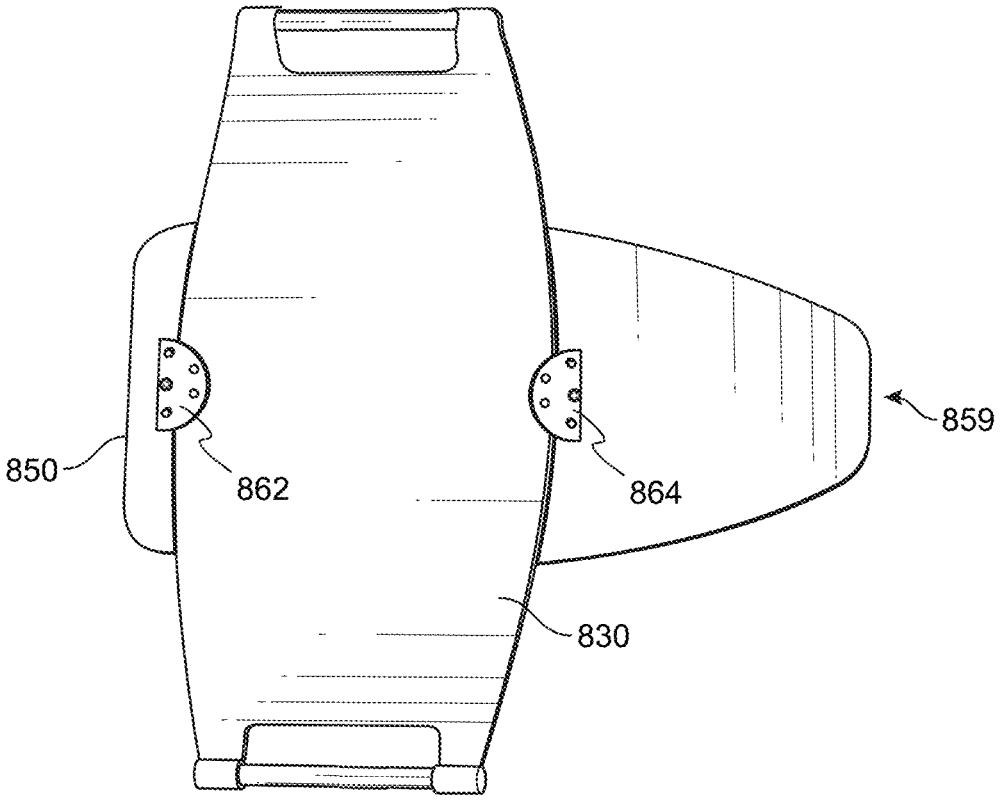
FIG. 8B is a diagram of a top view of the stabilizing member of FIG. 8A, to which a backboard has become fixedly attached according to an embodiment.

FIG. 8A shows an embodiment of a stabilizing member 850 that has a distal end 859. Stabilizing member 850 that has a fixed bracket 862 and a rotatable bracket 864, similarly to how brackets 762, 764 were provided on stabilizing member 750. Stabilizing member 850 also has a wide trough 857, with walls 858, for receiving therein a backboard. Stabilizing member 850 further has pegs 865 within a trough 857, so that the backboard can be pressed against them when brackets 862, 864 have engaged it. FIG. 8B shows how a backboard 830 has been attached to stabilizing member 850, by being received in trough 857, and engaged by brackets 862, 864.

Figure 9:
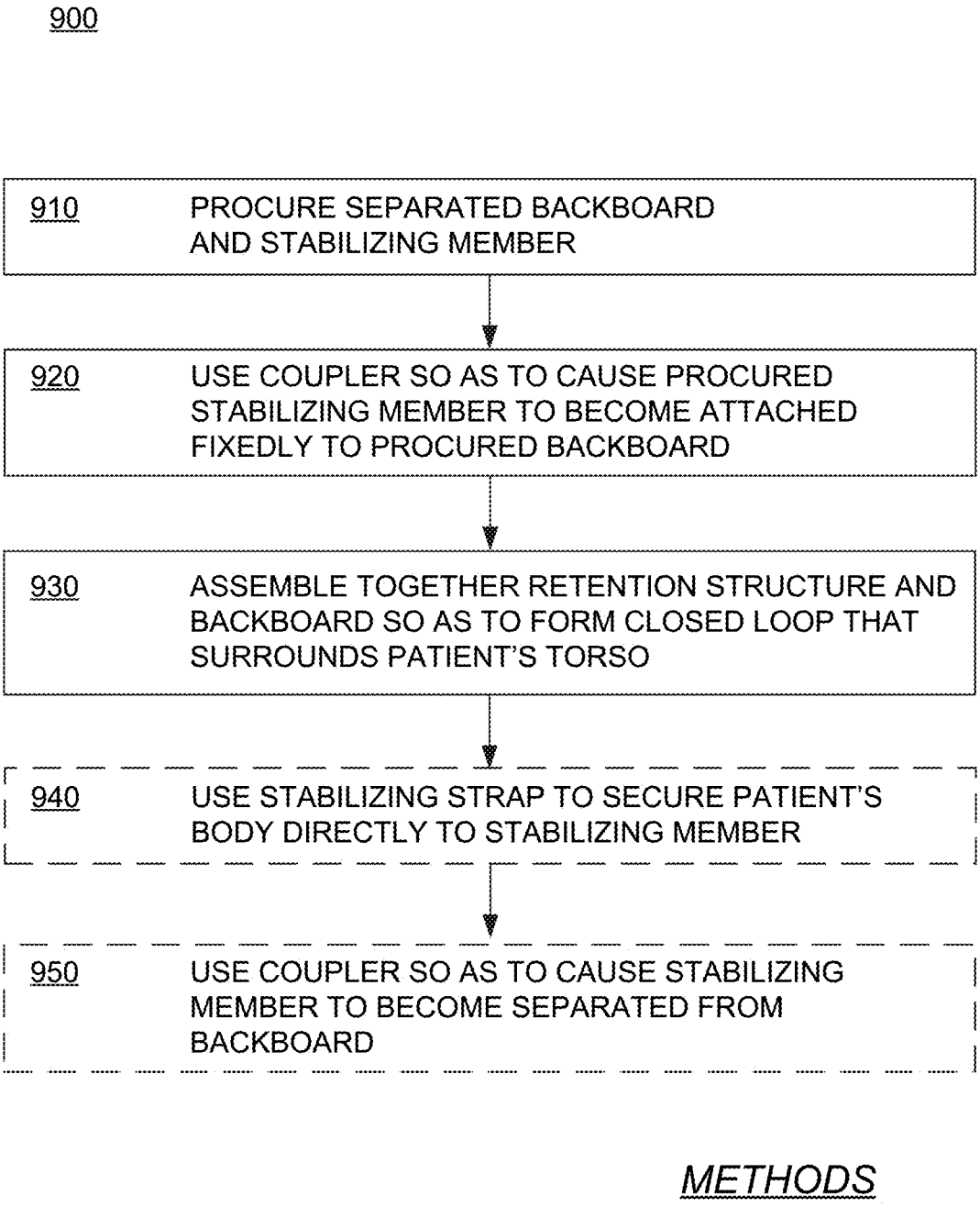
FIG. 9 is a flowchart for illustrating methods according to embodiments.

Methods are now described. FIG. 9 shows a flowchart 900 for describing methods according to embodiments for a rescuer to use a CPR system. According to an operation 910, a backboard and a stabilizing member are procured, while they are completely separated from each other.

According to another operation 920, a coupler is used so as to cause the procured stabilizing member to become attached fixedly to the procured backboard. As also seen above, in some embodiments the coupler includes a bracket that is coupled to one of the stabilizing member and the backboard, and the procured stabilizing member becomes thus attached to the procured backboard by engaging the bracket with the other one of the stabilizing member and the backboard. Further, in some of those embodiments, the bracket is thus engaged by being rotated.

According to another operation 930, a retention structure and the backboard are assembled together so as to form a closed loop that surrounds a torso of a patient completely, the assembly such that the piston can be moved towards and away from a chest of the patient.

According to another, optional operation 940, a stabilizing strap is used to secure a body of the patient directly to the stabilizing member. As also seen above, the stabilizing member could include an opening near a distal end, and the stabilizing strap can thus be used by being passed through the opening.

According to another, optional operation 950, the coupler can be used afterwards so as to cause the stabilizing member to become completely separated from the backboard. This could be performed for purposes of storage, after CPR chest compressions have been administered to the patient by the piston.

In some embodiments, the coupler is configured to couple the stabilizing member to the backboard in such a way that the stabilizing member can be rotated with respect to the backboard by at least 30° within a plane. Referring back to FIG. 4, this can be accomplished by various embodiments of coupler 460. For such embodiments, this rotation can be further visualized from FIG. 4, by picturing angle 461 changing. Specific examples are now described.

Figure 10A:
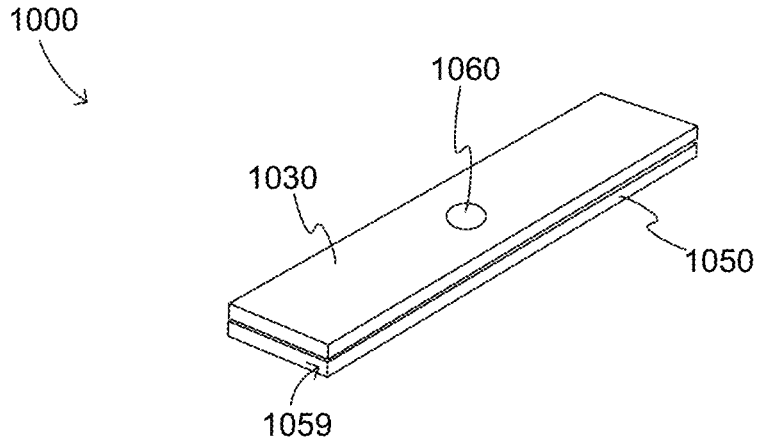
FIG. 10A is a diagram of a perspective view of a sample embodiment of a backboard, a stabilizing member, and a coupler that permits the backboard and the stabilizing member to rotate with respect to each other.

FIG. 10A shows combination 1000 of a backboard 1030, a stabilizing member 1050, and a coupler 1060. Stabilizing member 1050 has a distal end 1059. Coupler 1060 permits stabilizing member 1050 to rotate with respect to backboard 1030. Coupler 1060 may be implemented with a short axle, a shaft, or screws made of a hard material such as a metal.

The short axle or shaft can be perpendicular to backboard 1030, optionally terminate in small discs, and so on.

In the example of FIG. 10A, stabilizing member 1050 has a shape identical to the shape of backboard 1030, plus they are both aligned. Accordingly, if angle 461 of FIG. 4 had been shown in FIG. 10A, its value would be zero.

Figure 10B:
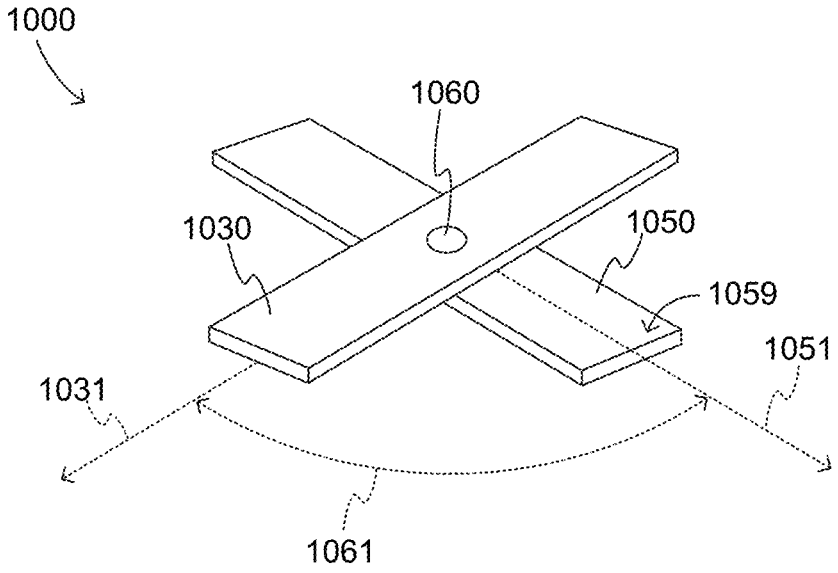
FIG. 10B is a diagram of the components of FIG. 10A, in which the stabilizing member has been rotated with respect to the backboard for greater stability.

FIG. 10B shows combination 1000 of FIG. 10A, but where stabilizing member 1050 having been rotated by an angle 1061 respect to backboard 1030. The rotation has been within a plane. Angle 1061 is subtended by an axis 1051 along the long dimension of stabilizing member 1050, and an axis 1031 parallel to the long dimension of backboard 1030. Angle 1061 is also within the plane defined by the intersecting axes 1051, 1031. Angle 1061 can acquire various values during the rotation, such as 30°, 70°, or 90° for a completely perpendicular relationship and the greatest stability. Rotation can be unlimited, or there can be a stop or other structure that limits the rotation at some angle.

In some embodiments, the backboard and/or stabilizing member includes one or more locking mechanisms to help lock the stabilizing member selectively in either the stabilization deployed mode, or the storage mode. For example, in one embodiment the locking mechanism may be implemented by using spring loaded balls that are fitted in the backboard, with corresponding holes or indentations in the stabilizing member for the 90° alignment of the stabilizing member and/or the storage mode alignment of the stabilizing member. Of course, other types of locking and/or snap fitting mechanisms can be used in other embodiments.

Figure 11A:
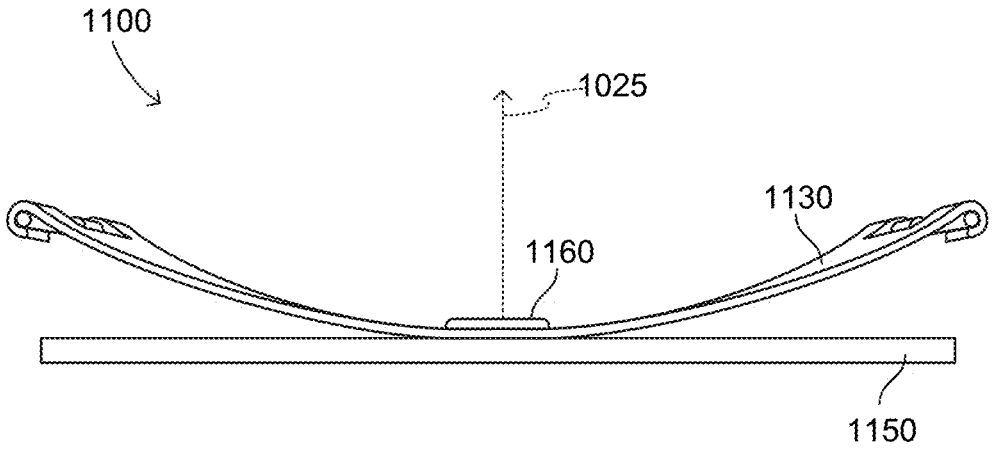
FIG. 11A is a diagram of a side view of an embodiment of a sample curved backboard and a sample stabilizing member of a CPR machine, in which the coupler permits them to rotate with respect to each other, according to embodiments.

It is not necessary that the stabilizing member have a shape identical to the shape of the backboard. For example, as seen in FIG. 11A, a backboard 1130 is coupled to a stabilizing member 1150 via a coupler 1160 in a combination 1100. Coupler 1160 permits stabilizing member 1150 to be rotated with respect to backboard 1130 around a semi-axis 1025. Backboard 1130 is curved; nevertheless, in the shown orientation backboard 1130 casts a footprint, and stabilizing member 1150 is shaped so that it can be brought completely within the footprint by rotation. This way, stabilizing member 1150 minimizes how much additional volume it requires for storage.

Figure 11B:
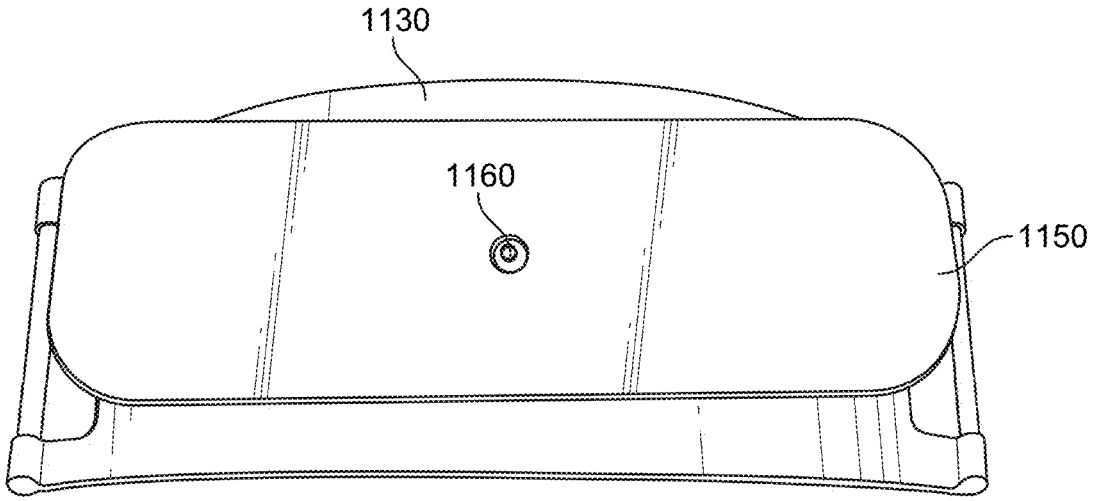
FIG. 11B is a diagram of a bottom view of the curved backboard and stabilizing member of FIG. 11A.

FIG. 11B shows a bottom view of the components of FIG. 11A. Axis 1025 is not shown and, if shown, it would point into the plane of the diagram.

Figure 11C:
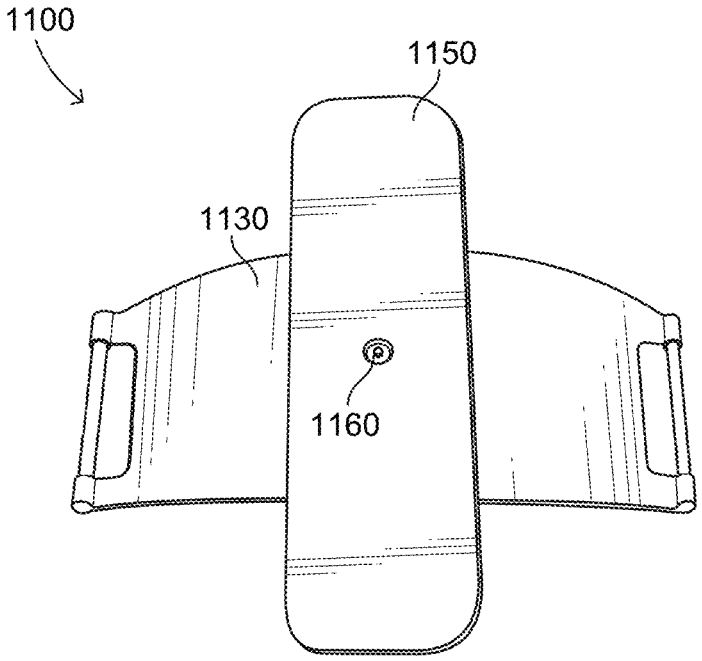
FIG. 11C is a diagram of a bottom view of the curved backboard and stabilizing member of FIG. 11B, where the stabilizing member has been rotated with respect to the backboard by 90°.
Figure 11D:
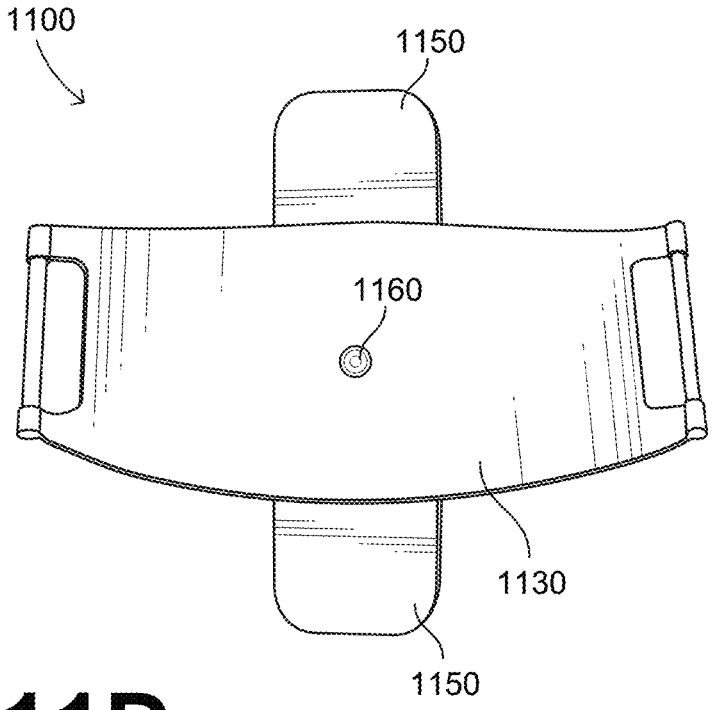
FIG. 11D is a diagram of a top view of the components of FIG. 11C.

FIG. 11C shows the bottom view of FIG. 11B, except that stabilizing member 1150 has been rotated with respect to backboard 1130 by 90°. FIG. 11D is a diagram of a top view of the components of FIG. 11C.

In some embodiments, there are additional stabilizers for the backboard. For example, some of the embodiments described above could further have an additional stabilizing member that is distinct from the retention structure, the backboard and the stabilizing member. Such an additional stabilizing member could be coupled to the backboard by an additional coupler, such that the additional stabilizing member can be rotated with respect to the backboard within another plane. The other plane could be the same or different than the plane of rotation of the original stabilizing member. The rotation of the additional stabilizing member can be by at least 30°, and possibly also larger angles as described above. Examples of embodiments with more than one stabilizer are now described.

Figure 12A:
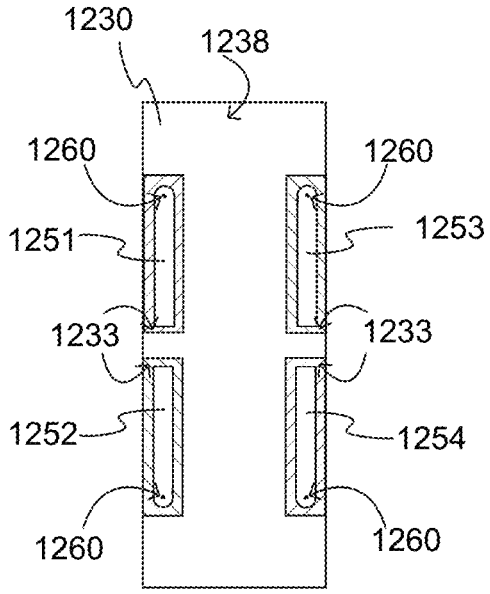
FIG. 12A is a diagram of a bottom view of a sample backboard of a CPR machine, which has four stabilizing members that are in a retracted state, and is made according to embodiments.

FIG. 12A shows a bottom view of a backboard 1230 for a CPR machine, which has a bottom surface 1238. Four stabilizing members 1251, 1252, 1253, 1254 are supported by couplers 1260, which may be implemented as pins that permit rotation. In FIG. 12A, stabilizing members 1251, 1252, 1253, 1254 are provided within recesses 1233 so as not to protrude from bottom surface 1238, when bottom surface 1238 is placed on the ground. In this example, stabilizing members 1251, 1252, 1253, 1254 are shown in a retracted state, which is suitable for storage. In the retracted state, stabilizing members 1251, 1252, 1253, 1254 are within the footprint of backboard 1230.

Figure 12B:
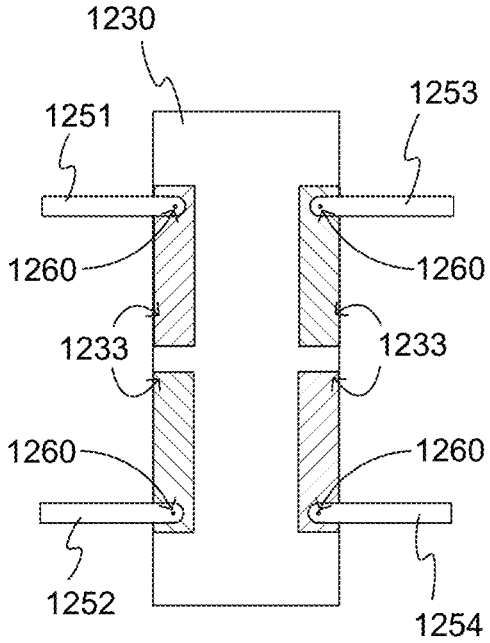
FIG. 12B is a diagram of a bottom view of the backboard of FIG. 12A, in which the stabilizing members are in a deployed state, according to embodiments.

FIG. 12B shows the backboard of FIG. 12A, where stabilizing members 1251, 1252, 1253, 1254 have been rotated around couplers 1260 by 90°. Accordingly, stabilizing members 1251, 1252, 1253, 1254 are in a deployed state that can enhance stability, as may be desired during use or when a model is displayed.

Figure 13A:
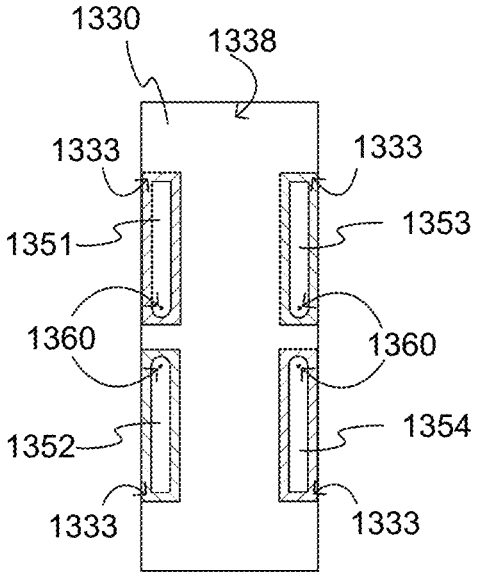
FIG. 13A is a diagram of a bottom view of another sample backboard of a CPR machine, which has four stabilizing members that are in a retracted state, and is made according to embodiments.

FIG. 13A shows a bottom view of a backboard 1330 for a CPR machine, which has a bottom surface 1338. Four stabilizing members 1351, 1352, 1353, 1354 are supported by couplers 1360, which may be implemented as pins that permit rotation. In FIG. 13A, stabilizing members 1351, 1352, 1353, 1354 are provided within recesses 1333, and are shown in a retracted state, similarly to what was described for backboard 1230. Moreover, FIG. 13B shows the backboard of FIG. 13A, where stabilizing members 1351, 1352, 1353, 1354 have been deployed by rotated by 90° around their couplers.

Figure 13B:
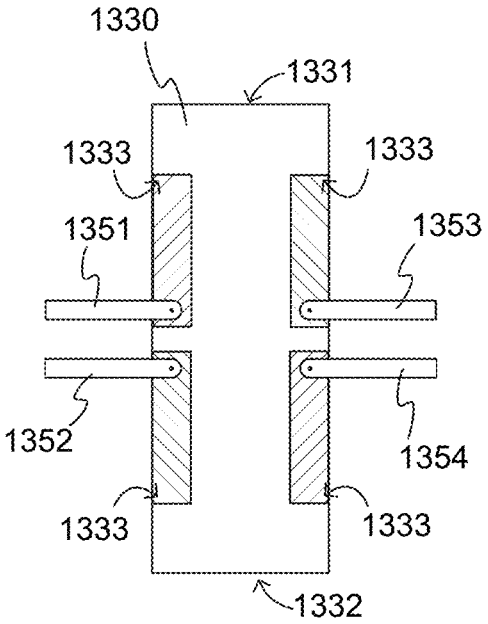
FIG. 13B is a diagram of a bottom view of the backboard of FIG. 13B, in which the stabilizing members are in a deployed state, according to embodiments.

What is different in FIGS. 13A and 13B from FIGS. 12A and 12B is the location of couplers 1360, which affects the deployment. In their deployed state, stabilizing members 1351, 1352, 1353, 1354 are closer to the middle of backboard 1330, and farther away from its ends 1331, 1332, than was the case in FIG. 12B. Accordingly, stabilizing members 1351, 1352, 1353, 1354 can be easier to implement for maintaining ground contact, in cases where backboard 1330 is curved and its ends 1331, 1332 are higher than the ground.

Figure 14:
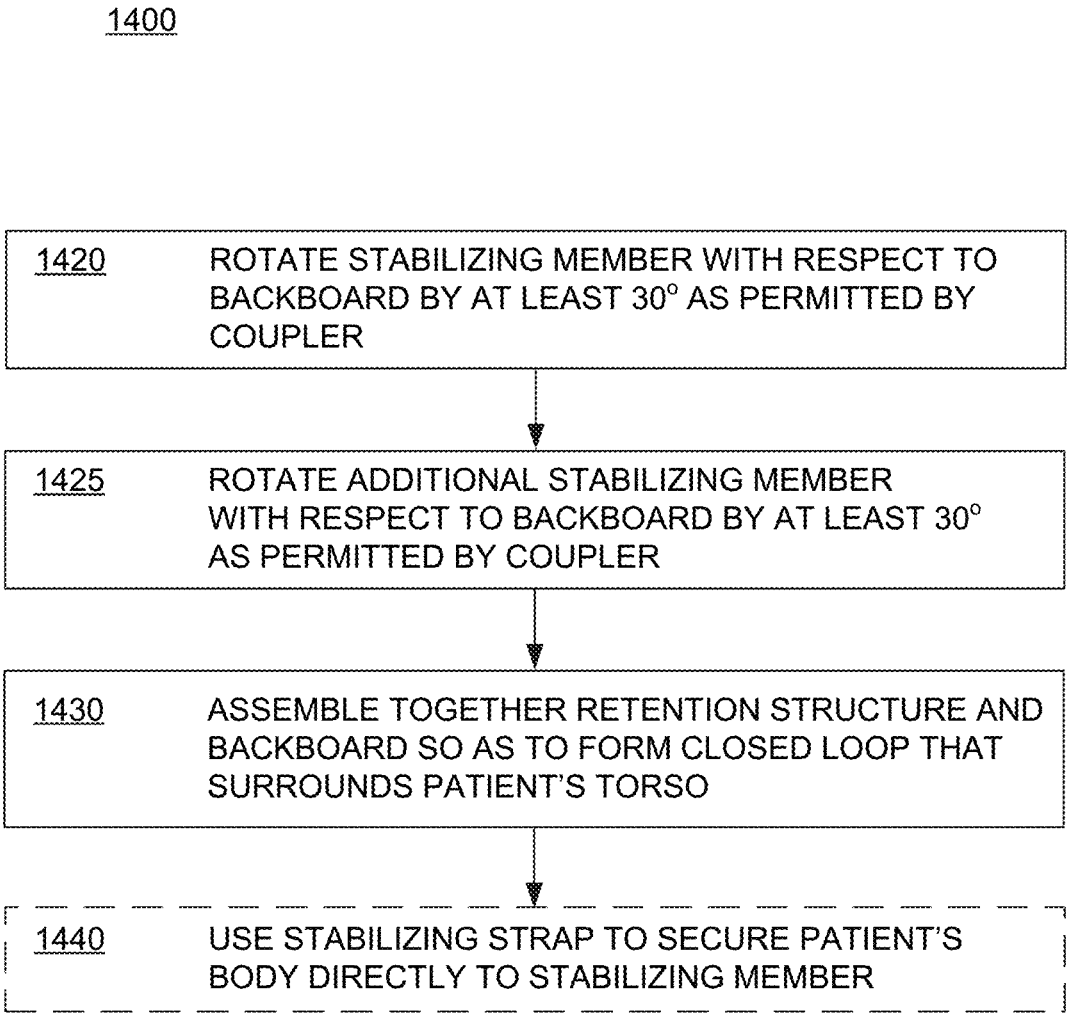
FIG. 14 is a flowchart for illustrating methods according to embodiments.

FIG. 14 shows a flowchart 1400 for describing methods according to embodiments for a rescuer to use a CPR system. According to an operation 1420, a stabilizing member of a CPR system is rotated with respect to a backboard of the CPR system by at least 30° within a plane, as permitted by the coupler. The stabilizing member can be thus rotated by larger angles, such as 70°, 90°, etc.

According to another, optional operation 1425, if an additional stabilizing member is provided with an additional coupler, the additional stabilizing member can be rotated with respect to the backboard by at least 30° within another plane, as permitted by the additional coupler. This rotation amounts to also deploying the additional stabilizing member.

According to another operation 1430, a retention structure and the backboard are assembled together so as to form a closed loop that surrounds a torso of a patient completely. The assembly can be such that a piston of the compression mechanism can be moved towards and away from a chest of the patient.

According to another, optional operation 1440, a stabilizing strap is used to secure a body of the patient directly to the stabilizing member. As also seen above, the stabilizing member could include an opening near a distal end, and the stabilizing strap can thus be used by being passed through the opening.

In the methods described above, each operation can be performed as an affirmative step of doing, or causing to happen, what is written that can take place. Such doing or causing to happen can be by the whole system or device, or just one or more components of it. It will be recognized that the methods and the operations may be implemented in a number of ways, including using systems, devices and implementations described above. In addition, the order of operations is not constrained to what is shown, and different orders may be possible according to different embodiments. Examples of such alternate orderings may include overlapping, interleaved, interrupted, reordered, incremental, preparatory, supplemental, simultaneous, reverse, or other variant orderings, unless context dictates otherwise. Moreover, in certain embodiments, new operations may be added, or individual operations may be modified or deleted. The added operations can be, for example, from what is mentioned while primarily describing a different system, apparatus, device or method.

In additional embodiments, a stretcher is modular so that it can be assembled around a backboard of a CPR machine. This permits rescuers to first attach the CPR machine so as to preserve the life of the patient, and then to assemble the stretcher for transporting to a care center. Such a stretcher can also be called a scoop board. The modular stretcher may be later disassembled for easier storing. Such a stretcher can be made, except where specified otherwise, by rigid materials such as hard plastic, metal, and so on.

In some embodiments, a modular stretcher is provided in combination with a CPR system that can be made as described above, and even such CPR systems that further lack a stabilizer. For example, returning to FIG. 3, the combination could apply to CPR machine 302, even if it lacked stabilizer 350.

In some embodiments, such a stretcher can be assembled around a backboard of such a CPR machine, when that backboard is on the ground and even when the CPR machine has been applied to a patient and is delivering chest compressions. This way, the patient can be transported without interrupting the on-going CPR chest compressions. The parts can be detachable for easy storing.

In some embodiments, such a stretcher includes a back segment, and a head segment that can be coupled to the back segment. Together they may define a blank space between them, in which the backboard can be received. In some embodiments, the back segment or the head segment or both engage the backboard, in whole or in part. Examples are now described.

Figure 15:
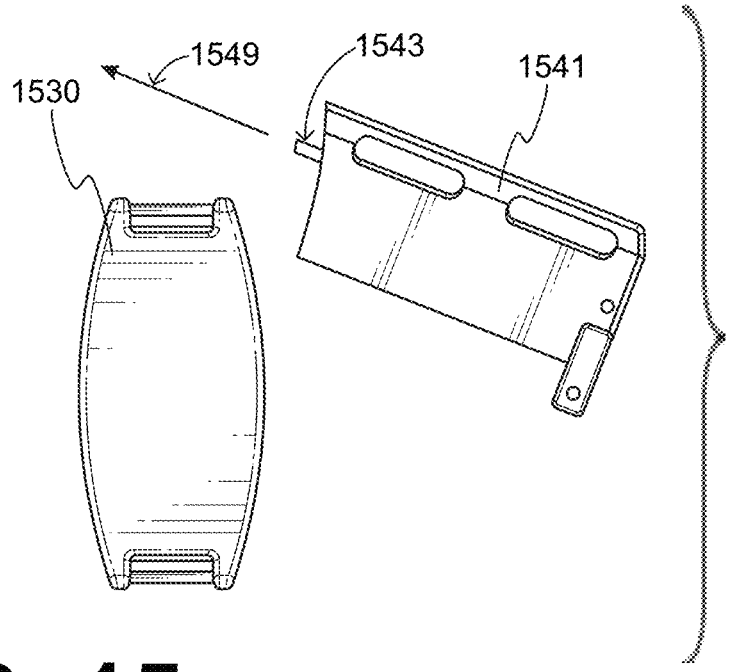
FIGS. 15-21 are diagrams showing top views of successive stages of assembling, around a backboard of a CPR machine that is on the ground, a sample modular stretcher made according to embodiments. In particular.

FIG. 15 shows a backboard 1530, which can be as described above for backboards. Backboard 1530 is considered to be on a floor or on the ground, with a patient on it. The remainder of the CPR machine or CPR system can be considered assembled with backboard 1530, but is not shown so as to permit better focus on the components of the modular stretcher.

In the embodiment of FIG. 15, the back segment has interlocking back portions, of which only left back portion 1541 is shown. In some embodiments, rods may be pulled out of the back segment for deployment, and then slid back into the back segment for storage. In the embodiment of FIG. 15, a rod 1543 may be pulled from left back portion 1541 in the direction of arrow 1549.

Figure 16:
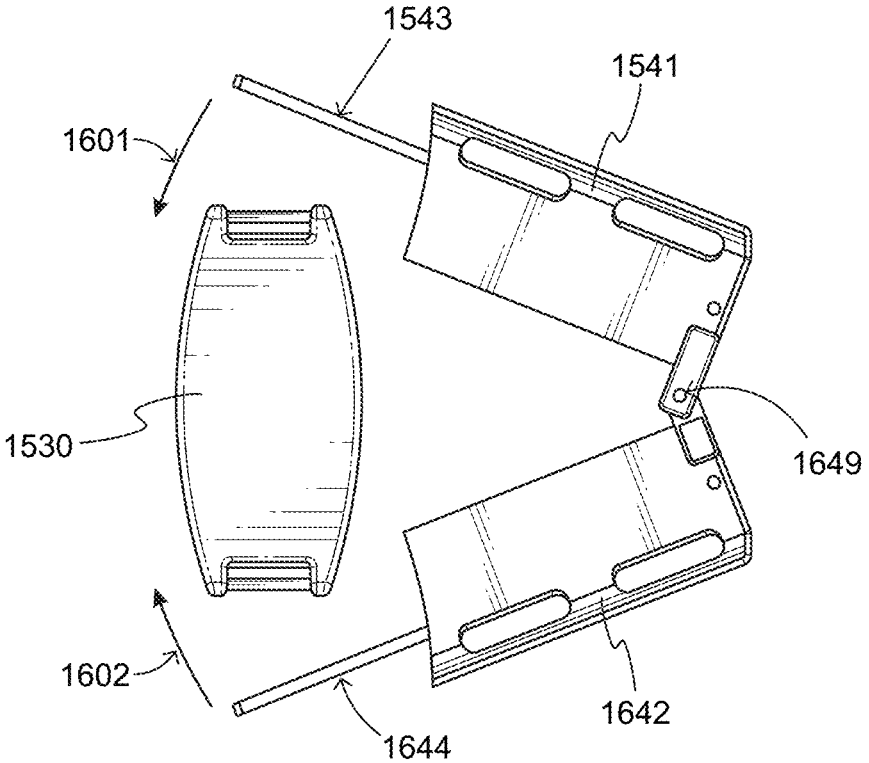

FIG. 16 shows the right back portion 1642, out of which another rod 1644 has been pulled. Right back portion 1642 is coupled with left back portion 1541 at a pin-joint 1649. This coupling permits rotation according to arrows 1601, 1602. Pin-joint 1649 makes it easy to pull left back portion 1541 and right back portion 1642 together beneath the patient.

Figure 17:
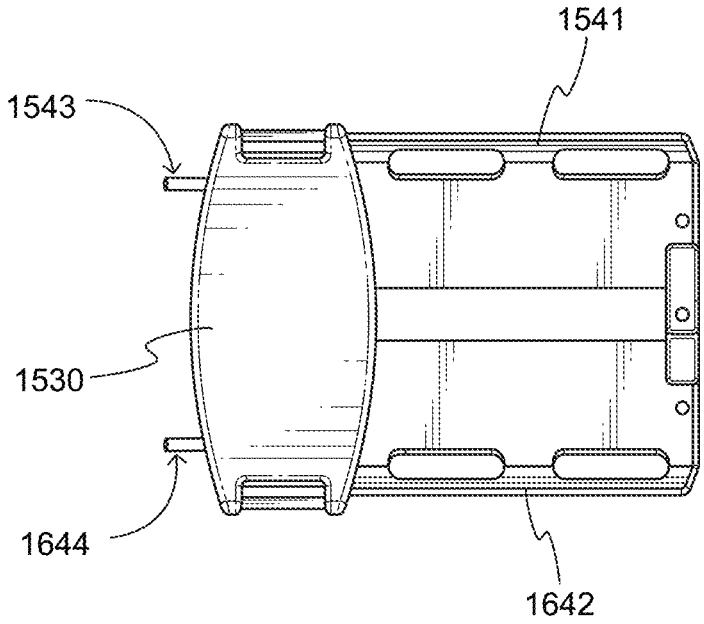

FIG. 17 shows the result of completing the rotation of arrows 1601, 1602, until back portions 1541, 1642 have been brought to be parallel to each other. Backboard 1530 can rest on rods 1543, 1644, or be engaged by them, locked by them, etc. Such engaging can be implemented by backboard 1530 having receptacles facing sideways, or holes through which rods 1543, 1644 can be inserted, and so on.

In some embodiments, the head segment includes a rigid portion and a soft portion. The head segment can be coupled, by its rigid portion, to the back segment. The soft portion can be made from canvas, sheet, or other materials that can be bent. An example is now described.

Figure 18:
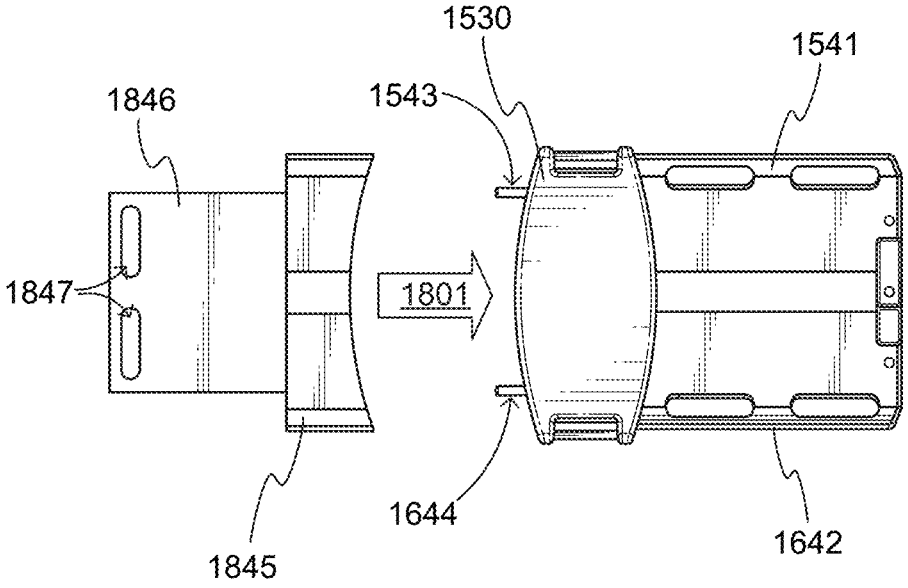

FIG. 18 shows the arrangement of FIG. 17, in which a head segment of the modular stretcher is brought close to backboard 1530 according to an arrow 1801. In FIG. 18, the head segment includes a rigid portion 1845 and a soft portion 1846 that is coupled to rigid portion 1845. Soft portion 1846 makes the overall head segment smaller, which is advantageous for storage. Soft portion 1846 includes hand openings 1847 through which a rescuer can grasp soft portion 1846 for transporting the modular stretcher with the patient on it.

Figure 19:
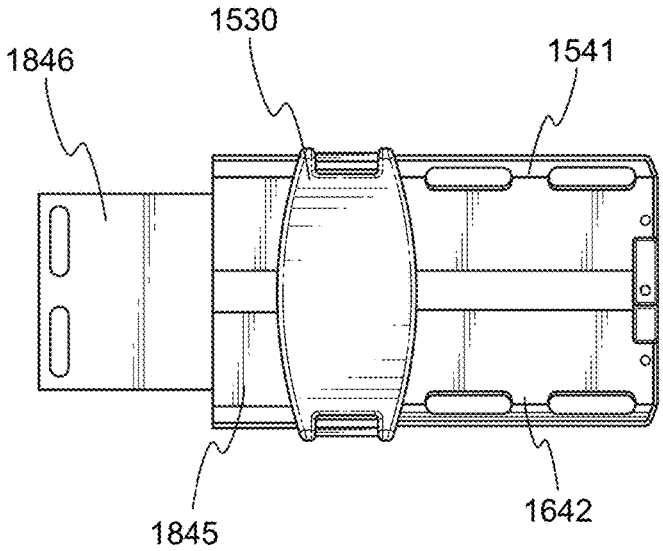

FIG. 19 shows the arrangement of FIG. 18, in which the head segment has been subsequently assembled. Rods 1543, 1644 of the back segment, shown in FIG. 18, have been received into rigid portion 1845, and latched in place by appropriate reversible mechanisms such as keys, locks, etc. In some embodiments, rigid portion 1845 is threaded over rods 1543, 1644.

Optionally, a modular stretcher according to embodiments further includes a legs segment that can be coupled to the back segment. The legs segment can be made from flexible materials such as canvas, in whole or in part. An example is in FIG. 20, which shows the arrangement of FIG. 19 wherein a legs segment 2047 is further being brought close according to arrow 2001. Legs segment 2047 includes hand openings 2048, through which a rescuer can grasp soft portion 2047 for transporting the modular stretcher with the patient on it. The flexibility permits both bending while turning around corners in narrow spaces, plus easier storage due to compactness.

Figure 20:
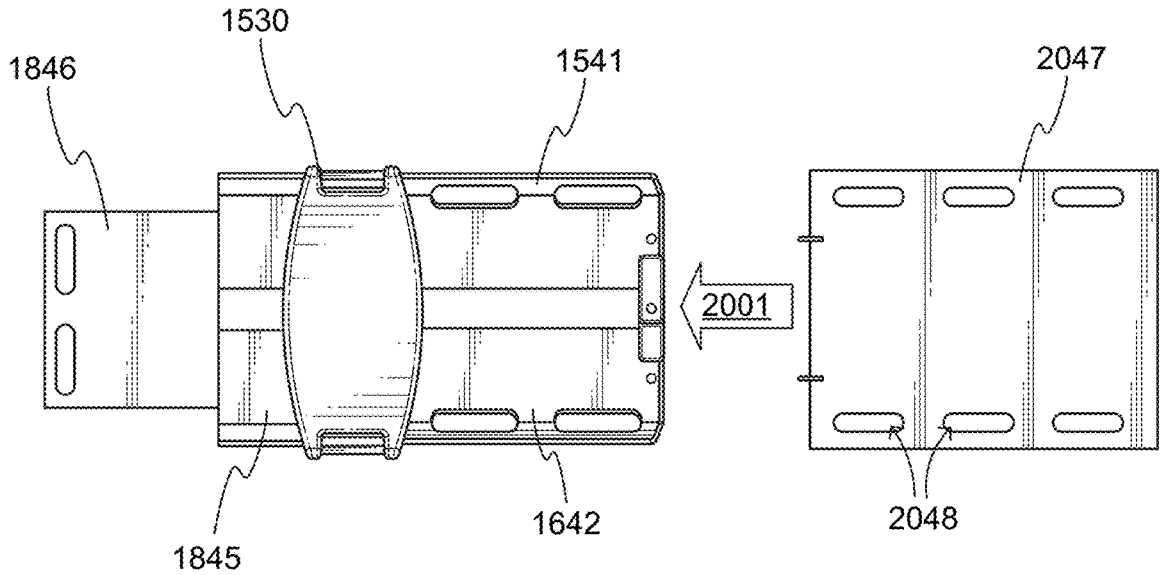
Figure 21:
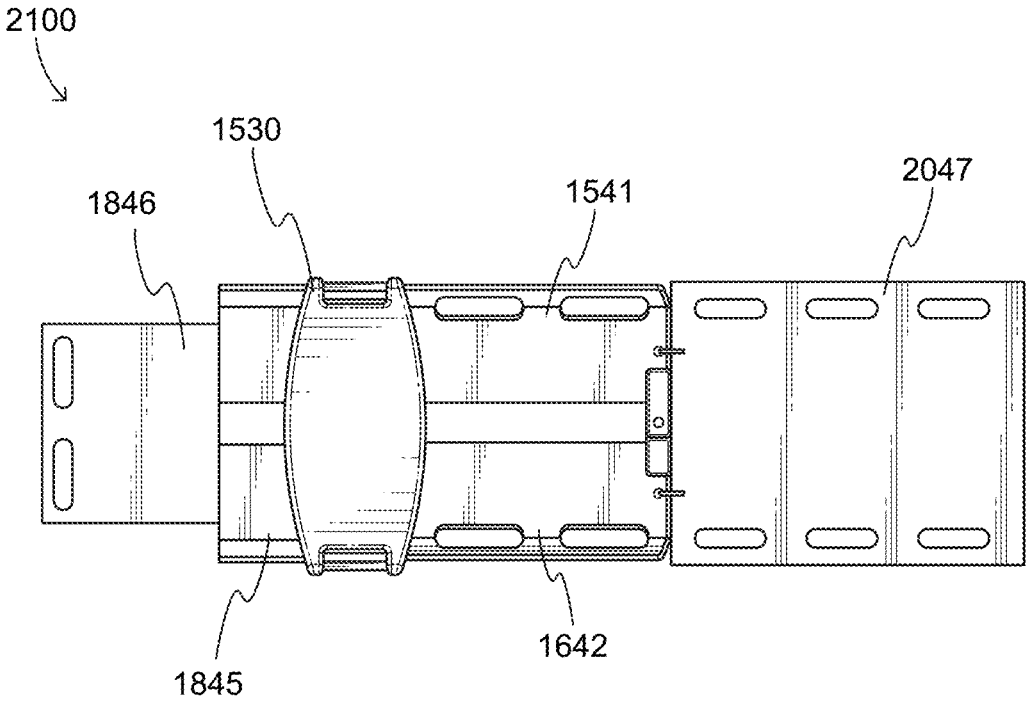
Figure 22:
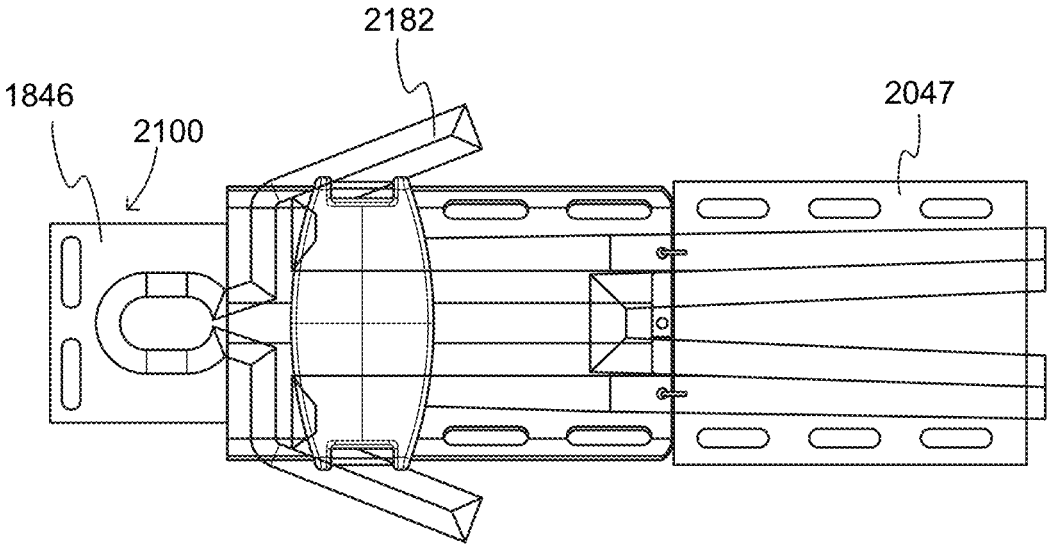
FIG. 22 shows the fully assembled arrangement of FIG. 21, and where a patient is further shown on it for reference.

FIG. 21 shows the arrangement of FIG. 20, in which the legs segment 2047 has been assembled with the remainder of the modular stretcher 2100. FIG. 22 shows the fully assembled arrangement 2100 of FIG. 21, plus where a patient 2182 is also shown for reference.

Figure 23A:
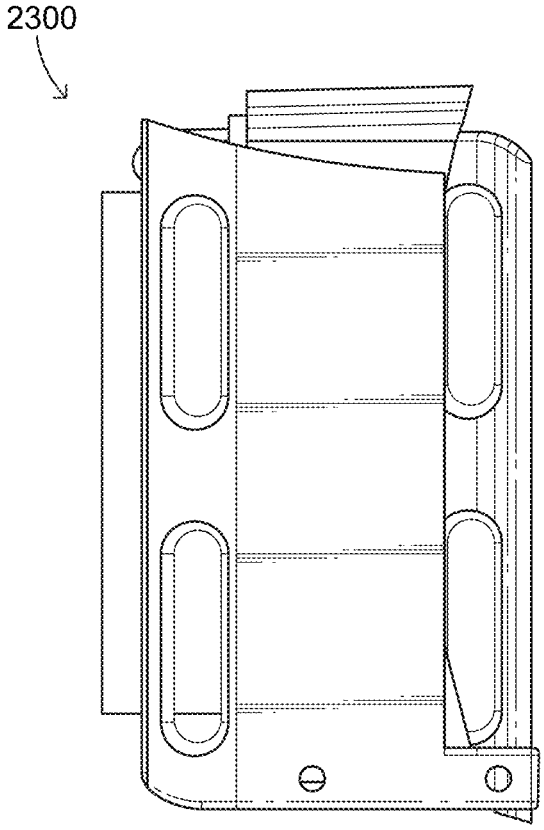
FIGS. 23A, 23B show views of the modular stretcher of FIG. 21, after it has been disassembled for compact storage.

FIG. 23A shows modular stretcher 2300, which is stretcher 2100 of FIG. 21 after it has been disassembled and arranged for compact storage. In FIG. 23A, the horizontal dimension is 270 mm, while the vertical dimension is 490 mm.

Figure 23B:
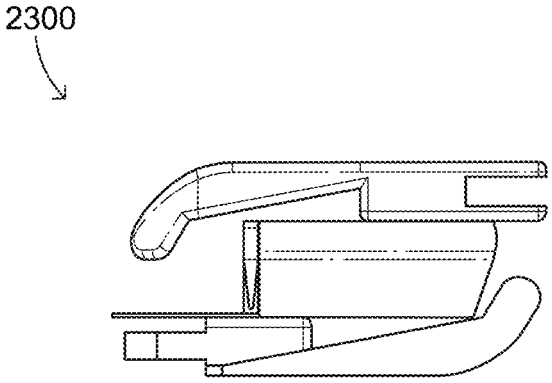

FIG. 23B shows modular stretcher 2300 from a different viewpoint than in FIG. 23A. In FIG. 23B, the horizontal dimension is 270 mm, while the vertical dimension is 110 mm.

Figure 24:
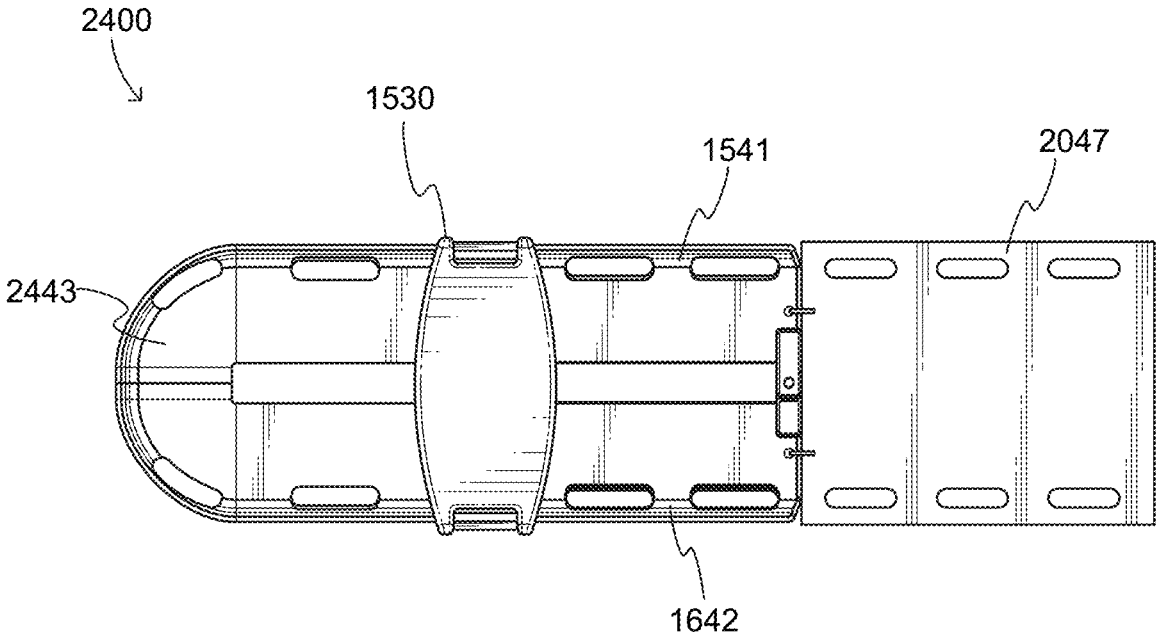
FIG. 24 shows a fully assembled modular stretcher according to another embodiment.

FIG. 24 shows a fully assembled modular stretcher 2400 according to another embodiment. Head segment 2443 is rigid, while other segments can be similar to what was described previously.

Figure 25:
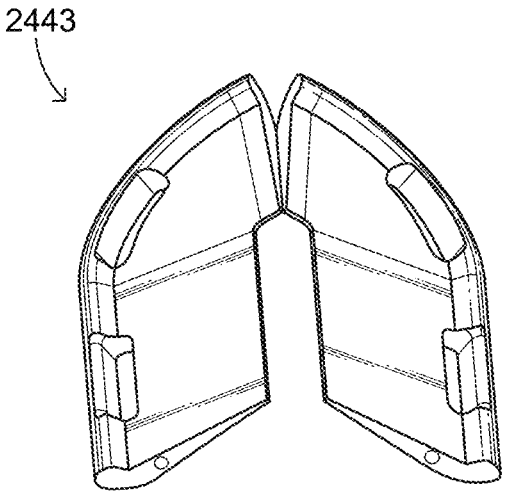
FIG. 25 shows a magnified detail of a head segment of the stretcher of FIG. 24.

FIG. 25 shows a magnified detail of a head segment 2443, while partially folded. It could be foldable downwards so that it would self-lock when in a carrying position.

Figure 26:
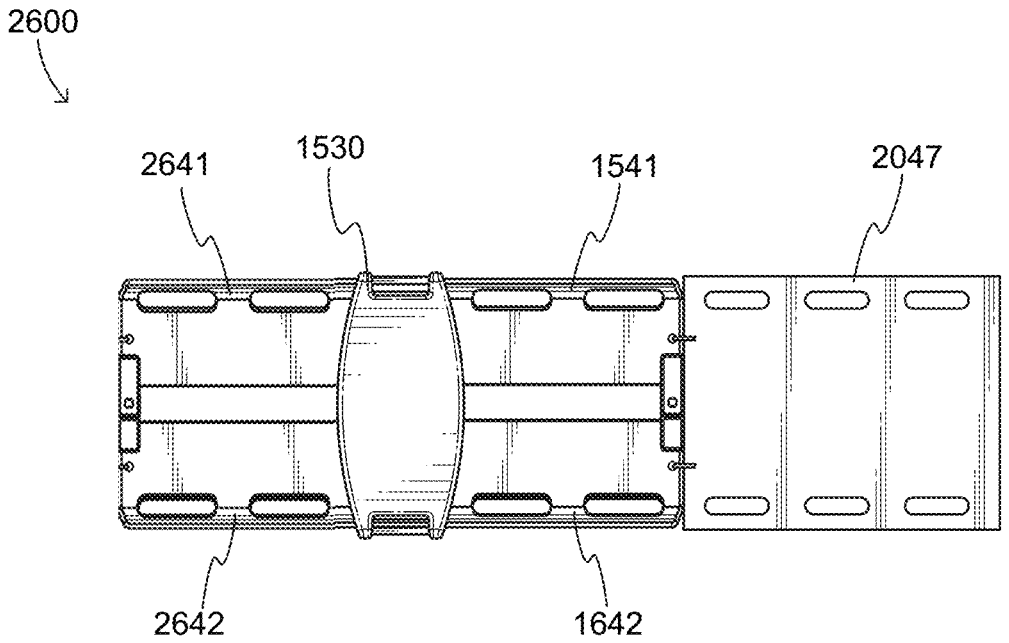
FIG. 26 shows a fully assembled modular stretcher according to one more embodiment.
Figure 27:
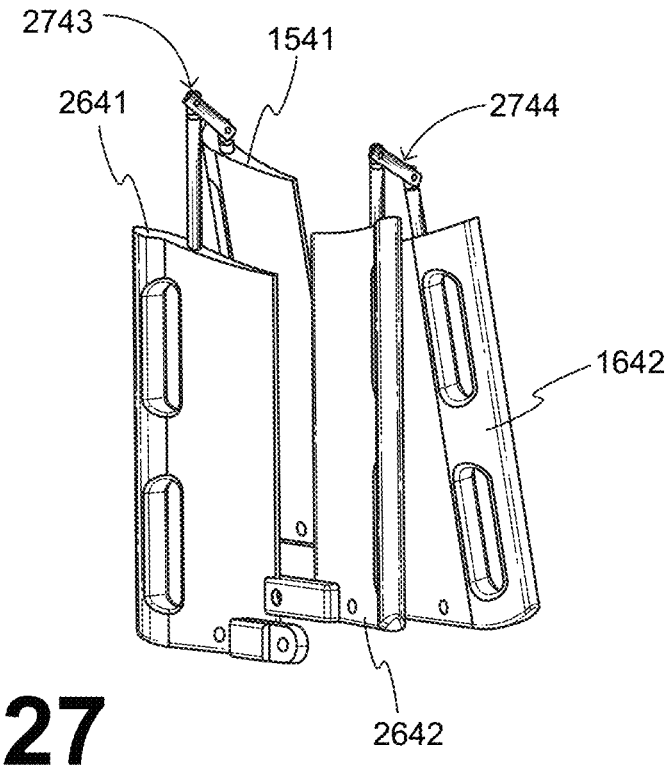
FIG. 27 shows a detail of components of the stretcher of FIG. 26, after they have been folded for storage.

FIG. 26 shows a fully assembled modular stretcher 2600 according to one more embodiment. The head segment has two interlocking portions 2641, 2642, while the other segments can be similar to what was described previously. The head segment could be made from the same parts as the back segment. Interlocking portions 2641, 2642 can be partly detachable, but not necessarily in the long direction. Instead they could include telescopic rods 2743, 2744 that can be extended far enough and be foldable, as shown in FIG. 27.

A person skilled in the art will be able to practice the present invention in view of this description, which is to be taken as a whole. Details have been included to provide a thorough understanding. In other instances, well-known aspects have not been described, in order to not obscure unnecessarily this description. Plus, any reference to any prior art in this description is not, and should not be taken as, an acknowledgement or any form of suggestion that such prior art forms parts of the common general knowledge in any country or any art.

This description includes one or more examples, but this fact does not limit how the invention may be practiced. Indeed, examples, instances, versions or embodiments of the invention may be practiced according to what is described, or yet differently, and also in conjunction with other present or future technologies. Other such embodiments include combinations and sub-combinations of features described herein, including for example, embodiments that are equivalent to the following: providing or applying a feature in a different order than in a described embodiment; extracting an individual feature from one embodiment and inserting such feature into another embodiment; removing one or more features from an embodiment; or both removing a feature from an embodiment and adding a feature extracted from another embodiment, while providing the features incorporated in such combinations and sub-combinations.

In this document, the phrases "constructed to" and/or "configured to" denote one or more actual states of construction and/or configuration that is fundamentally tied to physical characteristics of the element or feature preceding these phrases and, as such, reach well beyond merely describing an intended use. Any such elements or features can be implemented in a number of ways, as will be apparent to a person skilled in the art after reviewing the present disclosure, beyond any examples shown in this document.

Any and all parent, grandparent, great-grandparent, etc. patent applications, whether mentioned in this document or in an Application Data Sheet ("ADS") of this patent application, are hereby incorporated by reference herein as originally disclosed, including any priority claims made in those applications and any material incorporated by reference, to the extent such subject matter is not inconsistent herewith.

In this description a single reference numeral may be used consistently to denote a single item, aspect, component, or process. Moreover, a further effort may have been made in the drafting of this description to use similar though not identical reference numerals to denote other versions or embodiments of an item, aspect, component or process that are identical or at least similar or related. Where made, such a further effort was not required, but was nevertheless made gratuitously so as to accelerate comprehension by the reader. Even where made in this document, such a further effort might not have been made completely consistently for all of the versions or embodiments that are made possible by this description. Accordingly, the description controls in defining an item, aspect, component or process, rather than its reference numeral. Any similarity in reference numerals may be used to infer a similarity in the text, but not to confuse aspects where the text or other context indicates otherwise.

The claims of this document define certain combinations and subcombinations of elements, features and steps or operations, which are regarded as novel and non-obvious. Additional claims for other such combinations and subcombinations may be presented in this or a related document. These claims are intended to encompass within their scope all changes and modifications that are within the true spirit and scope of the subject matter described herein. The terms used herein, including in the claims, are generally intended as "open" terms. For example, the term "including" should be interpreted as "including but not limited to," the term "having" should be interpreted as "having at least," etc. If a specific number is ascribed to a claim recitation, this number is a minimum but not a maximum unless stated otherwise. For example, where a claim recites "a" component or "an" item, it means that it can have one or more of this component or item.

What is claimed is:

1. A Cardio-Pulmonary Resuscitation (CPR) system configured to perform compressions to a chest of a patient, the CPR system comprising:

a retention structure;

a compression mechanism coupled to the retention structure and having a movable piston;

a backboard that can be assembled together with the retention structure so as to form a closed loop around a torso of the patient and the piston is movable towards and away from the chest of the patient;

a coupler;

a stabilizing member that is coupled to the backboard via the coupler in such a way that the stabilizing member can be rotated with respect to the backboard by at least 30° within a plane; and at least one flexible stabilizing strap coupled to the stabilizing member.

2. The CPR system of claim 1, in which the stabilizing member has a shape of an oblong board.

3. The CPR system of claim 1, in which the stabilizing member is oblong, and has a distal end that is rounded.

4. The CPR system of claim 1, in which the stabilizing member and the backboard are made from the same materials.

5. The CPR system of claim 1, in which the stabilizing member can be rotated by at least 70°.

6. The CPR system of claim 1, in which the stabilizing member includes an opening, and the at least one flexible stabilizing strap is configured to be passed through the opening.

7. The CPR system of claim 1, further comprising:

an additional coupler; and an additional stabilizing member that is coupled to the backboard by the additional coupler such that the additional stabilizing member can be rotated with respect to the backboard by at least 30° within a plane.

8. A method for a rescuer to use a Cardio-Pulmonary Resuscitation (CPR) system that is configured to perform compressions to a chest of a patient, the CPR system including a retention structure, a compression mechanism coupled to the retention structure and having a movable piston, a backboard, a stabilizing member and a coupler coupling the stabilizing member to the backboard, and at least one flexible stabilizing strap, the method comprising:

rotating the stabilizing member with respect to the backboard by at least 30° within a plane as permitted by the coupler;

assembling together the retention structure and the backboard so as to form a closed loop around a torso of the patient and the piston can be moved towards and away from the chest of the patient; and using the stabilizing strap to secure a body of the patient.

9. The method of claim 8, in which the stabilizing member is rotated by at least 70°.

10. The method of claim 9, in which the stabilizing member includes an opening, and the stabilizing strap is thus used by being passed through the opening.

11. The method of claim 8, in which the CPR system further includes an additional coupler and an additional stabilizing member that is distinct from the retention structure and the stabilizing member, and the method further comprises: rotating the additional stabilizing member with respect to the backboard by at least 30° within a plane as permitted by the additional coupler.

12. A Cardio-Pulmonary Resuscitation (CPR) system configured to perform compressions to a chest of a patient, the CPR system comprising:

a retention structure;

a compression mechanism coupled to the retention structure and having a movable piston;

a backboard that can be assembled together with the retention structure so as to form a closed loop around a torso of the patient and the piston is movable towards and away from the chest of the patient;

a coupler;

a stabilizing member that is coupled to the backboard via the coupler in such a way that the stabilizing member can be rotated with respect to the backboard by at least 30° within a plane, the stabilizing member including an opening; and at least one flexible stabilizing strap configured to be passed through the opening.

* * * * *